US005944261A

United States Patent [19]

Heaslip et al.

[11] Patent Number: 5,944,261

[45] **Date of Patent: *Aug. 31, 1999**

[54] CASTING NOZZLE WITH MULTI-STAGE FLOW DIVISION

[75] Inventors: Lawrence John Heaslip; James Derek Dorricott, both of Burlington, Canada

[73] Assignee: Vesuvius Crucible Company, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/725,589

[22] Filed: Oct. 3, 1996

Related U.S. Application Data

[63] Continuation-in-part of application No. 08/233,049, Apr. 25, 1994, Pat. No. 5,785,880.

[51] Int. Cl.[6] ..... B05B 1/14

[52] U.S. Cl. ..... 239/553.5

[58] Field of Search ..... 222/591, 594, 222/606; 239/553, 553.5, 590, 552, 590.5

[56] References Cited

U.S. PATENT DOCUMENTS

| | | | |
|---|---|---|---|
| 563,630 | 7/1896 | Webster | 239/552 |
| 1,790,908 | 2/1931 | Fitts | 239/552 |
| 3,848,811 | 11/1974 | Fryback | 239/552 |
| 4,221,271 | 9/1980 | Barker | 239/553.5 X |
| 4,566,614 | 1/1986 | Frykendahl . | |
| 4,671,433 | 6/1987 | Podrini et al. . | |
| 4,858,794 | 8/1989 | Sugiura et al. . | |
| 5,198,126 | 3/1993 | Lee . | |
| 5,314,099 | 5/1994 | Butz et al. . | |

FOREIGN PATENT DOCUMENTS

| | | |
|---|---|---|
| 9529025 | 11/1995 | Canada . |
| 0254909 | 2/1988 | European Pat. Off. . |
| 0403808 | 12/1990 | European Pat. Off. . |
| 0482423 | 4/1992 | European Pat. Off. . |
| 0685282 | 12/1995 | European Pat. Off. . |
| 0694359 | 1/1996 | European Pat. Off. . |
| 0709153 | 5/1996 | European Pat. Off. . |
| 3709188 | 9/1988 | Germany . |
| 4116723 | 6/1992 | Germany . |
| 4142447 | 12/1992 | Germany . |
| 4319966 | 12/1994 | Germany . |
| 61226149 | 10/1996 | Japan . |
| 8912519 | 12/1989 | United Kingdom . |

*Primary Examiner*—Kevin Weldon

*Attorney, Agent, or Firm*—Ostrolenk, Faber, Gerb & Soffen, LLP

[57] ABSTRACT

A method and apparatus for flowing liquid metal through a casting nozzle includes an elongated bore having an entry port and at least two exit ports. A first baffle is positioned proximate to one exit port and a second baffle is positioned proximate to the other exit port. The baffles divide the flow of liquid metal into two outer streams and a central stream, and deflect the two outer streams in substantially opposite directions. A flow divider positioned downstream of the baffles divides the central stream into two inner streams, and cooperates with the baffles to deflect the two inner streams in the same or different direction in which the two outer streams are deflected.

40 Claims, 13 Drawing Sheets

FIG. 1a
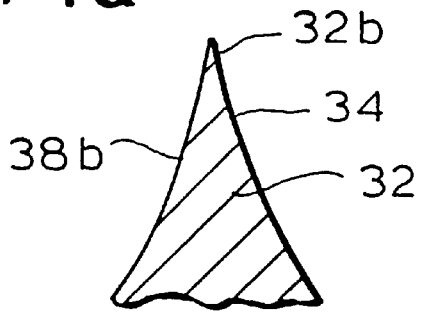
FIG. 17a
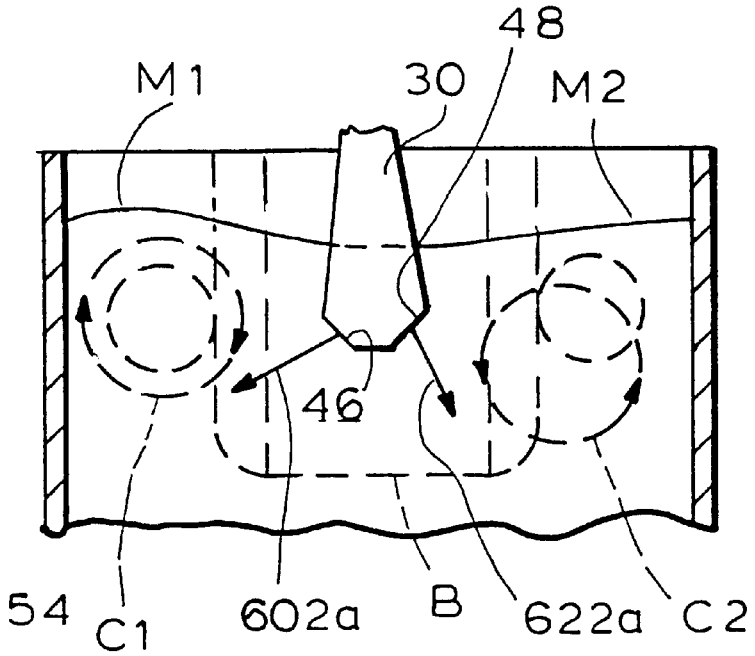
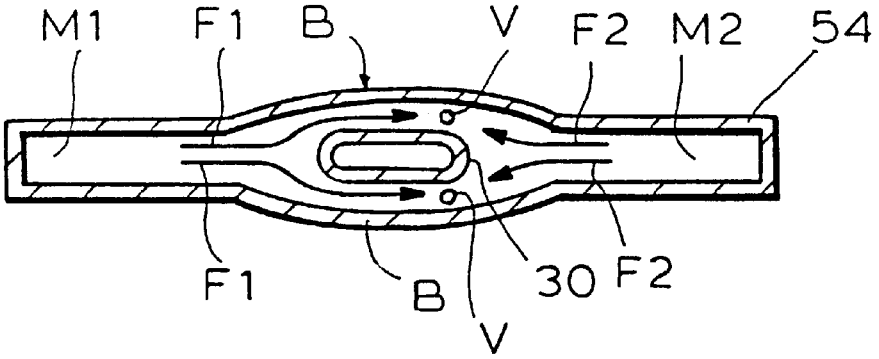
FIG. 17b

FIG. 7
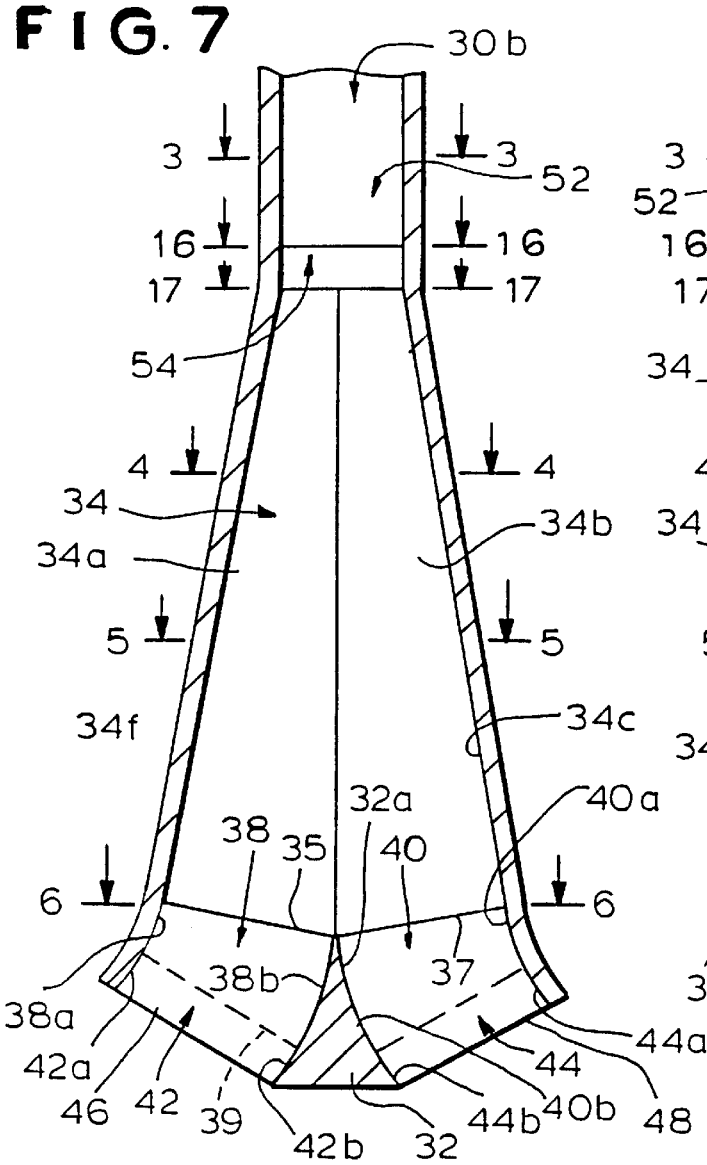
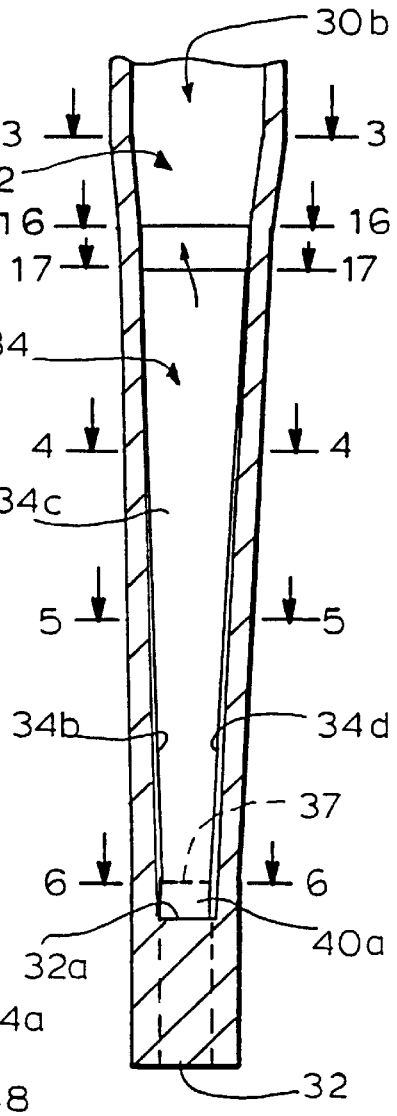
FIG. 8
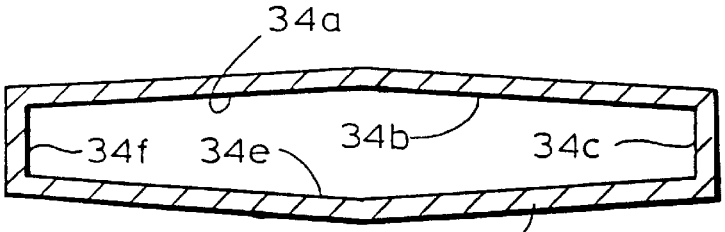
FIG. 6a
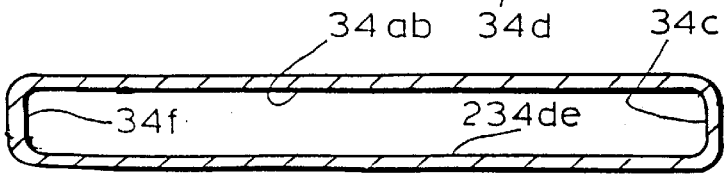
FIG. 6b

CASTING NOZZLE WITH MULTI-STAGE FLOW DIVISION

CROSS-REFERENCE TO RELATED APPLICATIONS

This application is a continuation-in-part of application Ser. No. 08/233,049, filed Apr. 25, 1994 now U.S. Pat. No. 5,785,880.

BACKGROUND OF THE INVENTION

1. Field of the Invention

The present invention relates to a casting or submerged entry nozzle and more particularly to a casting or submerged entry nozzle that improves the flow behavior associated with the introduction of liquid metal into a mold through a casting nozzle.

2. Description of the Related Art

In the continuous casting of steel, e.g., slabs having, for example, thicknesses of 50 to 60 mm and widths of 975 to 1625 mm, there is often employed a casting or submerged entry nozzle. The casting nozzle contains liquid steel as it flows into a mold and introduces the liquid metal into the mold in a submerged manner.

The casting nozzle is commonly a pipe with a single entrance on one end and one or two exits located at or near the other end. The inner bore of the casting nozzle between the entrance region and the exit region is often simply a cylindrical axially symmetric pipe section.

The casting nozzle has typical outlet dimensions of 25 to 40 mm widths and 150 to 250 mm lengths. The exit region of the nozzle may simply be an open end of the pipe section. The nozzle may also incorporate two oppositely directed outlet ports in the sidewall of the nozzle where the end of the pipe is closed. The oppositely directed outlet ports deflect molten steel streams at apparent angles between 10 and 90 degrees relative to the vertical.

The nozzle entrance is connected to the source of a liquid metal. The source of liquid metal in the continuous casting process is called a tundish.

The purposes of using a casting nozzle are:

(1) to carry liquid metal from the tundish into the mold without exposing the liquid metal to air;

(2) to evenly distribute the liquid metal in the mold so that heat extraction and solidified shell formation are uniform; and (3) to deliver the liquid metal to the mold in a quiescent and smooth manner, without excessive turbulence particularly at the meniscus, so as to allow good lubrication, and minimize the potential for surface defect formation.

The rate of flow of liquid metal from the tundish into the casting nozzle may be controlled in various ways. Two of the more common methods of controlling the flow rate are: (1) with a stopper rod, and (2) with a slide gate valve. In either instance, the nozzle must mate with the tundish stopper rod or tundish slide gate and the inner bore of the casting nozzle in the entrance region of the nozzle is generally cylindrical and may be radiused or tapered.

Heretofore, prior art casting nozzles accomplish the aforementioned first purpose if they are properly submerged within the liquid steel in the mold and maintain their physical integrity.

Prior art nozzles, however, do not entirely accomplish the aforementioned second and third purposes. For example, FIGS. 19 and 20 illustrate a typical design of a two-ported prior art casting nozzle with a closed end. This nozzle attempts to divide the exit flow into two opposing outlet streams. The first problem with this type of nozzle is the acceleration of the flow within the bore and the formation of powerful outlets which do not fully utilize the available area of the exit ports. The second problem is jet oscillation and unstable mold flow patterns due to the sudden redirection of the flow in the lower region of the nozzle. These problems do not allow even flow distribution in the mold and cause excessive turbulence.

FIG. 20 illustrates an alternative design of a two-ported prior art casting nozzle with a pointed flow divider end. The pointed divider attempts to improve exit jet stability. However, this design experiences the same problems as those encountered with the design of FIG. 18. In both cases, the inertial force of the liquid metal travelling along the bore towards the exit port region of the nozzle can be so great that it cannot be deflected to fill the exit ports without flow separation at the top of the ports. Thus, the exit jets are unstable, produce oscillation and are turbulent.

Moreover, the apparent deflection angles are not achieved. The actual deflection angles are appreciably less. Furthermore, the flow profiles in the outlet ports are highly non-uniform with low flow velocity at the upper portion of the ports and high flow velocity adjacent the lower portion of the ports. These nozzles produce a relatively large standing wave in the meniscus or surface of the molten steel, which is covered with a mold flux or mold powder for the purpose of lubrication. These nozzles further produce oscillation in the standing wave wherein the meniscus adjacent one mold end alternately rises and falls and the meniscus adjacent the other mold end alternately falls and rises. Prior art nozzles also generate intermittent surface vortices. All of these effects tend to cause entrainment of mold flux in the body of the steel slab, reducing its quality. Oscillation of the standing wave causes unsteady heat transfer through the mold at or near the meniscus. This effect deleteriously affects the uniformity of steel shell formation, mold powder lubrication, and causes stress in the mold copper. These effects become more and more severe as the casting rate increases; and consequently it becomes necessary to limit the casting rate to produce steel of a desired quality.

Referring now to FIG. 17, there is shown a nozzle 30 similar to that described in European Application 0403808. As is known to the art, molten steel flows from a tundish through a valve or stopper rod into a circular inlet pipe section 30*b*. Nozzle 30 comprises a circular-to-rectangular main transition 34. The nozzle further includes a flat-plate flow divider 32 which directs the two streams at apparent plus and minus 90 degree angles relative to the vertical. However, in practice the deflection angles are only plus and minus 45 degrees. Furthermore, the flow velocity in outlet ports 46 and 48 is not uniform. Adjacent the right diverging side wall 34*c* of transition 34 the flow velocity from port 48 is relatively low as indicated by vector 627. Maximum flow velocity from port 48 occurs very near flow divider 32 as indicated by vector 622. Due to friction, the flow velocity adjacent divider 32 is slightly less, as indicated by vector 621. The non-uniform flow from outlet port 48 results in turbulence. Furthermore, the flow from ports 46 and 48 exhibit a low frequency oscillation of plus and minus 20 degrees with a period of from 20 to 60 seconds. At port 46 the maximum flow velocity is indicated by vector 602 which corresponds to vector 622 from port 48. Vector 602 oscillates between two extremes, one of which is vector 602*a*, displaced by 65 degrees from the vertical and the other of which is vector 602*b*, displaced by 25 degrees from the vertical.

As shown in FIG. 17*a,* the flows from ports 46 and 48 tend to remain 90 degrees relative to one another so that when the output from port 46 is represented by vector 602*a,* which is deflected by 65 degrees from the vertical, the output from port 48 is represented by vector 622*a* which is deflected by 25 degrees from the vertical. At one extreme of oscillation shown in FIG. 17*a,* the meniscus M1 at the left-hand end of mold 54 is considerably raised while the meniscus M2 at the right mold end is only slightly raised. The effect has been shown greatly exaggerated for purposes of clarity. Generally, the lowest level of the meniscus occurs adjacent nozzle 30. At a casting rate of three tons per minute, the meniscus generally exhibits standing waves of 18 to 30 mm in height. At the extreme of oscillation shown, there is a clockwise circulation C1 of large magnitude and low depth in the left mold end and a counter-clockwise circulation C2 of lesser magnitude and greater depth in the right mold end.

As shown in FIGS. 17*a* and 17*b,* adjacent nozzle 30 there is a mold bulge region B where the width of the mold is increased to accommodate the nozzle, which has typical refractory wall thicknesses of 19 mm. At the extreme of oscillation shown in FIG. 17*a,* there is a large surface flow F1 from left-to-right into the bulge region in front of and behind nozzle 30. There is also a small surface flow F2 from right-to-left toward the bulge region. Intermittent surface vortices V occur in the meniscus in the mold bulge region adjacent the right side of nozzle 30. The highly non-uniform velocity distribution at ports 46 and 48, the large standing waves in the meniscus, the oscillation in the standing waves, and the surface vortices all tend to cause entrainment of mold powder or mold flux with a decrease in the quality of the cast steel. In addition, steel shell formation is unsteady and non-uniform, lubrication is detrimentally affected, and stress within mold copper at or near the meniscus is generated. All of these effects are aggravated at higher casting rates. Such prior art nozzles require that the casting rate be reduced.

Referring again to FIG. 17, the flow divider may alternately comprise an obtuse triangular wedge 32*c* having a leading edge included angle of 156 degrees, the sides of which are disposed at angles of 12 degrees from the horizontal, as shown in a first German Application DE 3709188, which provides apparent deflection angles of plus and minus 78 degrees. However, the actual deflection angles are again approximately plus and minus 45 degrees; and the nozzle exhibits the same disadvantages as before.

Referring now to FIG. 18, nozzle 30 is similar to that shown in a second German Application DE 4142447 wherein the apparent deflection angles are said to range between 10 and 22 degrees. The flow from the inlet pipe 30*b* enters the main transition 34 which is shown as having apparent deflection angles of plus and minus 20 degrees as defined by its diverging side walls 34*c* and 34*f* and by triangular flow divider 32. If flow divider 32 were omitted, an equipotential of the resulting flow adjacent outlet ports 46 and 48 is indicated at 50. Equipotential 50 has zero curvature in the central region adjacent the axis S of pipe 30*b* and exhibits maximum curvature at its orthoganal intersection with the right and left sides 34*c* and 34*f* of the nozzle. The bulk of the flow in the center exhibits negligible deflection; and only flow adjacent the sides exhibits a deflection of plus and minus 20 degrees. In the absence of a flow divider, the mean deflections at ports 46 and 48 would be less than ¼ and perhaps ⅕ or 20% of the apparent deflection of plus and minus 20 degrees.

Neglecting wall friction for the moment, 64*a* is a combined vector and streamline representing the flow adjacent the left side 34*f* of the nozzle and 66*a* is a combined vector and streamline representing the flow adjacent the right side 34*c* of the nozzle. The initial point and direction of the streamline correspond to the initial point and direction of the vector; and the length of the streamline corresponds to the length of the vector. Streamlines 64*a* and 66*a* of course disappear into the turbulence between the liquid in the mold and the liquid issuing from nozzle 30. If a short flow divider 32 is inserted, it acts substantially as a truncated body in two dimensional flow. The vector-streamlines 64 and 66 adjacent the body are of higher velocity than the vector-streamlines 64*a* and 66*a*. Streamlines 64 and 66 of course disappear into the low pressure wake downstream of flow divider 32. This low pressure wake turns the flow adjacent divider 32 downwardly. The latter German application shows the triangular divider 32 to be only 21% of the length of main transition 34. This is not sufficient to achieve anywhere near the apparent deflections, which would require a much longer triangular divider with corresponding increase in length of the main transition 34. Without sufficient lateral deflection, the molten steel tends to plunge into the mold. This increases the amplitude of the standing wave, not by an increase in height of the meniscus at the mold ends, but by an increase in the depression of the meniscus in that portion of the bulge in front of and behind the nozzle where flow therefrom entrains liquid from such portion of the bulge and produces negative pressures.

The prior art nozzles attempt to deflect the streams by positive pressures between the streams, as provided by a flow divider.

Due to vagaries in manufacture of the nozzle, the lack of the provision of deceleration or diffusion of the flow upstream of flow division and to low frequency oscillation in the flows emanating from ports 46 and 48, the center streamline of the flow will not generally strike the point of triangular flow divider 32 of FIG. 18. Instead, the stagnation point generally lies on one side or the other of divider 32. For example, if the stagnation point is on the left side of divider 32 then there occurs a laminar separation of flow on the right side of divider 32. The separation "bubble" decreases the angular deflection of flow on the right side of divider 32 and introduces further turbulence in the flow from port 48.

SUMMARY OF THE INVENTION

Accordingly, it is an object of our invention to provide a casting nozzle that improves the flow behavior associated with the introduction of liquid metal into a mold through a casting nozzle.

Another object is to provide a casting nozzle wherein the inertial force of the liquid metal flowing through the nozzle is divided and better controlled by dividing the flow into separate and independent streams within the bore of the nozzle in a multiple stage fashion.

A further object is to provide a casting nozzle that results in the alleviation of flow separation, and therefore the reduction of turbulence, stabilization of exit jets, and the achievement of a desired deflection angle for the independent streams.

It is also an object to provide a casting nozzle to diffuse or decelerate the flow of liquid metal travelling therethrough and therefore reduce the inertial force of the flow so as to stabilize the exit jets from the nozzle.

It is another object to provide a casting nozzle wherein deflection of the streams is accomplished in part by negative pressures applied to the outer portions of the streams, as by curved terminal bending sections, to render the velocity distribution in the outlet ports more uniform.

A further object is to provide a casting nozzle having a main transition from circular cross-section containing a flow of axial symmetry, to an elongated cross-section with a thickness which is less than the diameter of the circular cross-section and a width which is greater than the diameter of the circular cross-section containing a flow of planar symmetry with generally uniform velocity distribution throughout the transition neglecting wall friction.

A still further object is to provide a casting nozzle having a hexagonal cross-section of the main transition to increase the efficiency of flow deflections within the main transition.

A still further object is to provide a casting nozzle having diffusion between the inlet pipe and the outlet ports to decrease the velocity of flow from the ports and reduce turbulence.

A still further object is to provide a casting nozzle having diffusion or deceleration of the flow within the main transition of cross-section to decrease the velocity of the flow from the ports and improve the steadiness of velocity and uniformity of velocity of streamlines at the ports.

A still further object is to provide a casting nozzle having a flow divider provided with a rounded leading edge to permit variation in stagnation point without flow separation.

It has been found that the above and other objects of the present invention are attained in a method and apparatus for flowing liquid metal through a casting nozzle that includes an elongated bore having an entry port and at least two exit ports. A first baffle is positioned proximate to one exit port and a second baffle is positioned proximate to the other exit port.

The baffles divide the flow of liquid metal into two outer streams and a central stream, and deflect the two outer streams in substantially opposite directions. A flow divider positioned downstream of the baffles divides the central stream into two inner streams, and cooperates with the baffles to deflect the two inner streams in substantially the same direction in which the two outer streams are deflected.

Preferably, the outer and inner streams recombine before or after the streams exit at least one of the exit ports.

In a preferred embodiment, the baffles deflect the outer streams at an angle of deflection of approximately 20–90 degrees from the vertical. Preferably, the baffles deflect the outer streams at an angle of approximately 30 degrees from the vertical.

In a preferred embodiment, the baffles deflect the two inner streams in a different direction from the direction in which the two outer streams are deflected. Preferably, the baffles deflect the two outer streams at an angle of approximately 45 degrees from the vertical and deflect the two inner streams at an angle of approximately 30 degrees from the vertical.

Other feature and objects of our invention will become apparent from the following description of the invention which refers to the accompanying drawings.

BRIEF DESCRIPTION OF THE DRAWINGS

In the accompanying drawings which form part of the instant specification and which are to be read in conjunction therewith and in which like reference numerals are used to indicate like parts in the various views:

FIG. 1*a* is a fragmentary cross-section looking rearwardly of a preferred flow divider having a rounded leading edge.

FIG. 6*a* is an alternative cross-section taken in the plane 6—6 of FIGS. 1 and 2, looking downwardly.

FIG. 6*b* is a cross-section taken in the plane 6—6 of FIGS. 13 and 14 and of FIGS. 15 and 16, looking downwardly.

FIG. 7 is an axial sectional view looking rearwardly of a second casting nozzle having a constant area round-to-rectangular transition, a hexagonal small-angle diverging main transition with diffusion, and moderate terminal bending.

FIG. 8 is an axial sectional view looking to the right of the nozzle of FIG. 7.

FIG. 17*a* is a sectional view, looking rearwardly, showing the mold flow patterns produced by the nozzle of FIG. 17.

FIG. 17*b* is a cross-section in the curvilinear plane of the meniscus, looking downwardly, and showing the surface flow patterns produced by the nozzle of FIG. 17.

DESCRIPTION OF THE PREFERRED EMBODIMENTS

Figure 1:
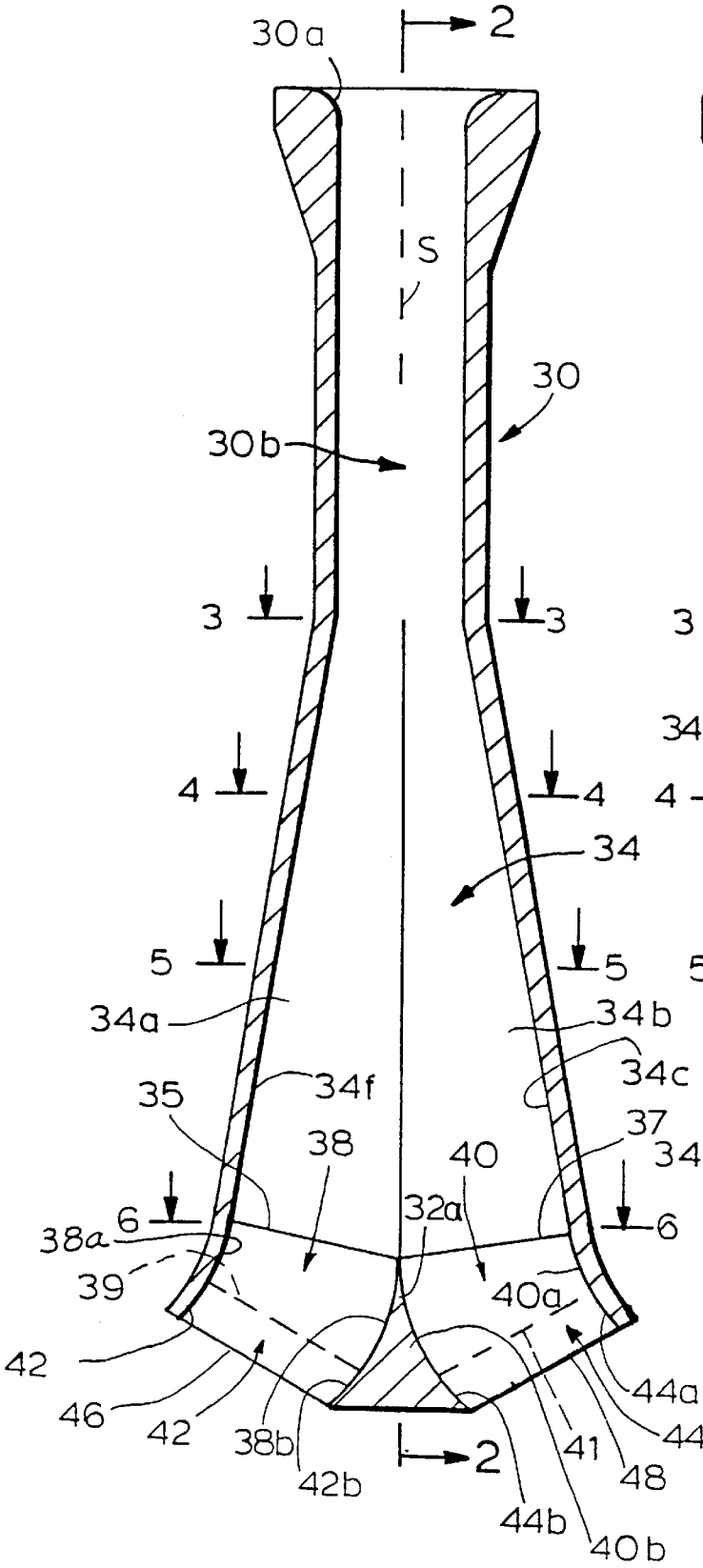
FIG. 1 is an axial sectional view looking rearwardly taken along the line 1—1 of FIG. 2 of a first casting nozzle having a hexagonal small-angle diverging main transition with diffusion, and moderate terminal bending.
Figure 2:
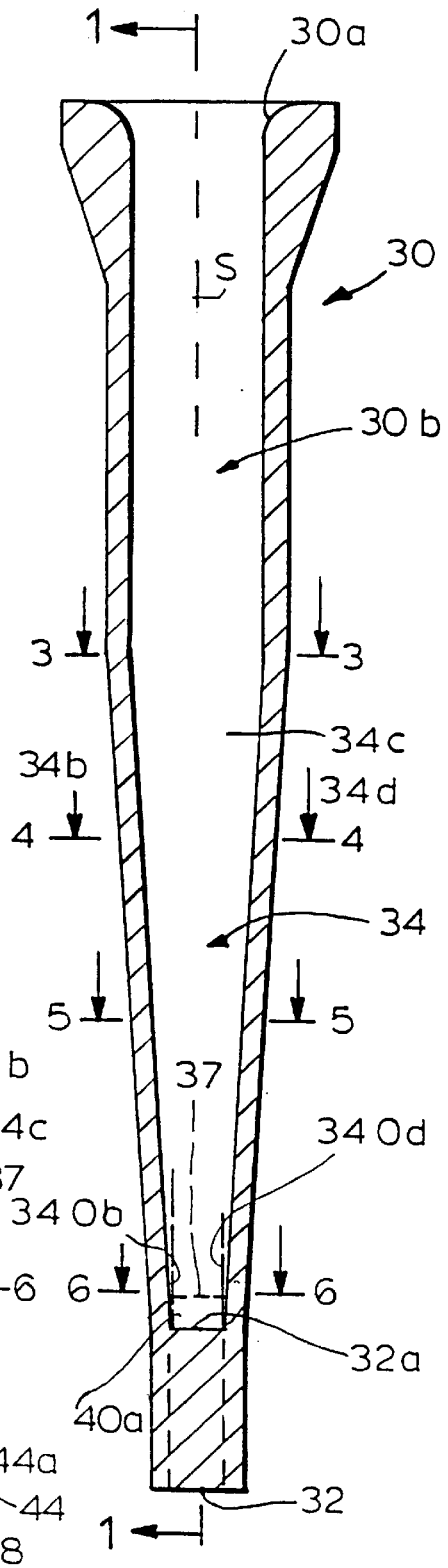
FIG. 2 is an axial sectional view looking to the right taken along the line 2—2 of FIG. 1.
Figure 1B:
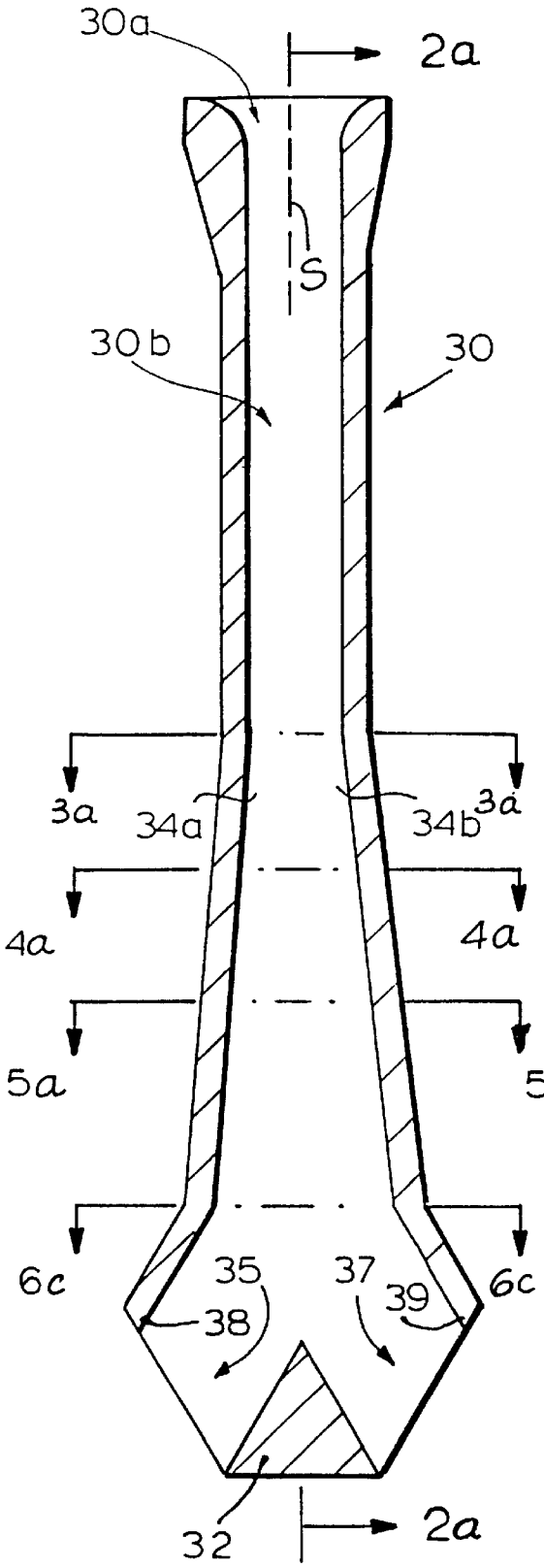
FIG. 1*b* is an alternate axial sectional view taken along the line 1*b*—1*b* of FIG. 2*a* of an alternate embodiment of a casting nozzle, having a main transition with deceleration and diffusion, and deflection of the outlet flows.
Figure 2A:
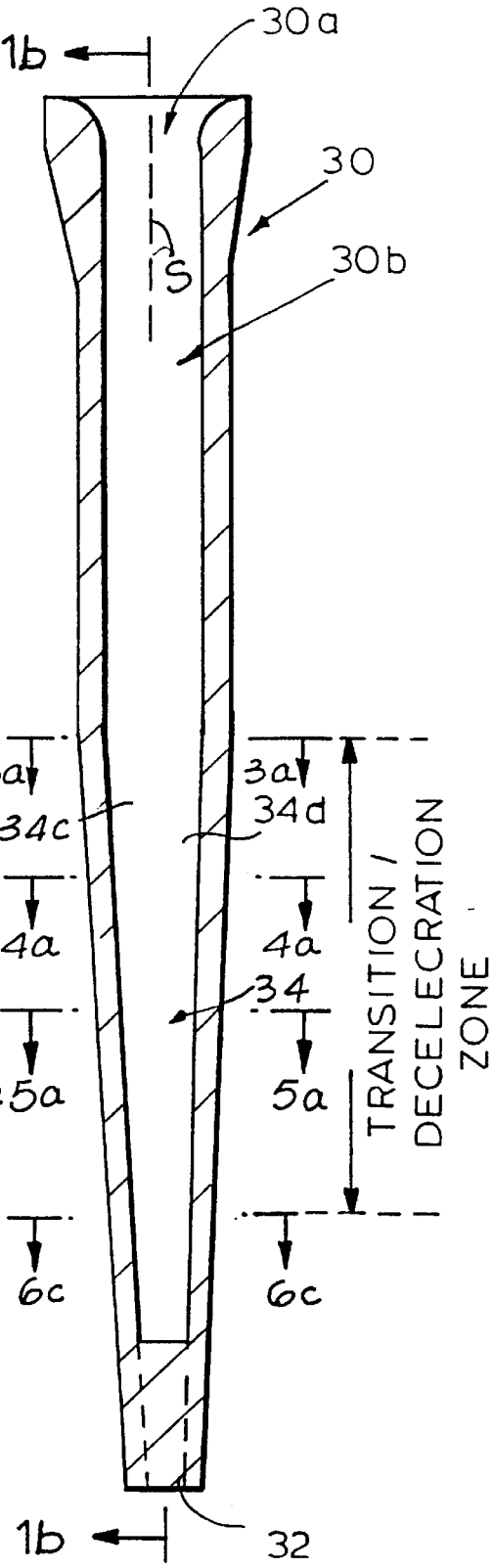
FIG. 2*a* is an axial sectional view taken along the line 2*a*—2*a* of FIG. 1*b*.
Figure 3:
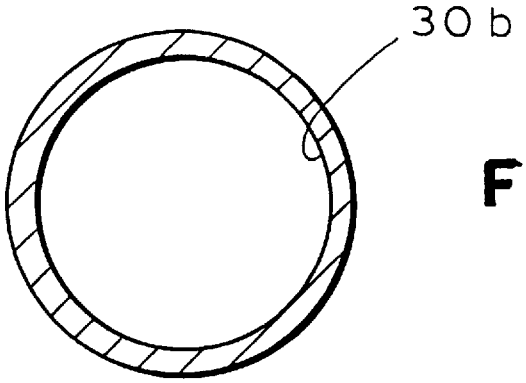
FIG. 3 is a cross-section taken in the plane 3—3 of FIGS. 1 and 2, looking downwardly.
Figure 3A:
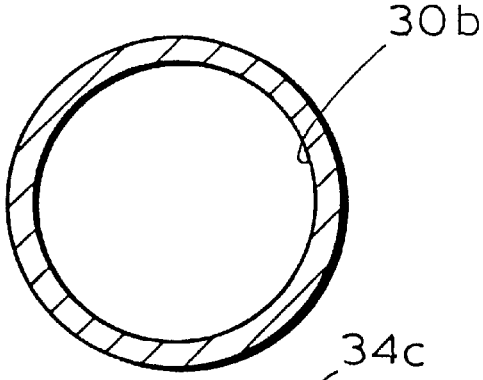
FIG. 3*a* is a cross-section taken in the plane 3*a*—3*a* of FIGS. 1*b* and 2*a*.

Referring now to FIGS. 1*b* and 2*a,* the casting nozzle is indicated generally by the reference numeral 30. The upper end of the nozzle includes an entry nozzle 30*a* terminating in a circular pipe or bore 30*b* which extends downwardly, as shown in FIGS. 1*b* and 2*a*. The axis of pipe section 30*b* is considered as the axis S of the nozzle. Pipe section 30*b* terminates at the plane 3*a*—3*a* which, as can be seen from FIG. 3*a*, is of circular cross-section. The flow then enters the main transition indicated generally by the reference numeral 34 and preferably having four walls 34*a* through 34*d*. Side walls 34*a* and 34*b* each diverge at an angle from the vertical. Front walls 34*c* and 34*d* converge with rear walls 34*a* and 34*b*. It should be realized by those skilled in the art that the transition area 34 can be of any shape or cross-sectional area of planar symmetry and need not be limited to a shape having the number of walls (four of six walls) or cross-sectional areas set forth herein just so long as the transition area 34 changes from a generally round cross-sectional area to a generally elongated cross-sectional area of planar symmetry, see FIGS. 3*a*, 4*a*, 5*a*, 6*c*.

For a conical two-dimensional diffuser, it is customary to limit the included angle of the cone to approximately 8 degrees to avoid undue pressure loss due to incipient separation of flow. Correspondingly, for a one-dimensional rectangular diffuser, wherein one pair of opposed walls are parallel, the other pair of opposed walls should diverge at an included angle of not more than 16 degrees; that is, plus 8 degrees from the axis for one wall and minus 8 degrees from the axis for the opposite wall. For example, in the diffusing main transition 34 of FIG. 1*b,* a 2.65 degree mean convergence of the front walls and a 5.2 degree divergence of side walls yields an equivalent one-dimensional divergence of the side walls of 10.4−5.3=5.1 degrees, approximately, which is less than the 8 degree limit.

Figure 4:
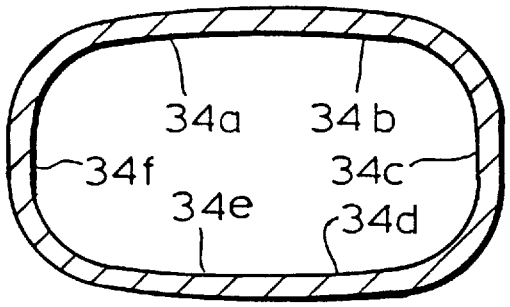
FIG. 4 is a cross-section taken in the plane 4—4 of FIGS. 1 and 2, looking downwardly.
Figure 5:
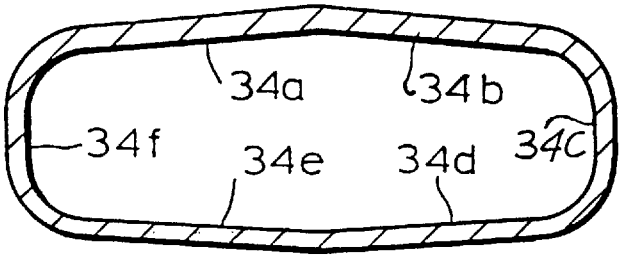
FIG. 5 is a cross-section taken in the plane 5—5 of FIGS. 1 and 2, looking downwardly.
Figure 6:
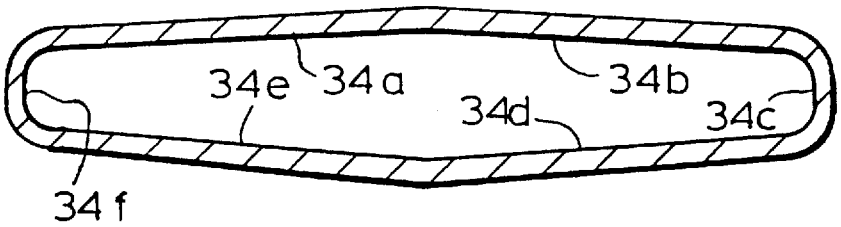
FIG. 6 is a cross-section taken in the plane 6—6 of FIGS. 1 and 2, looking downwardly.
Figure 4A:
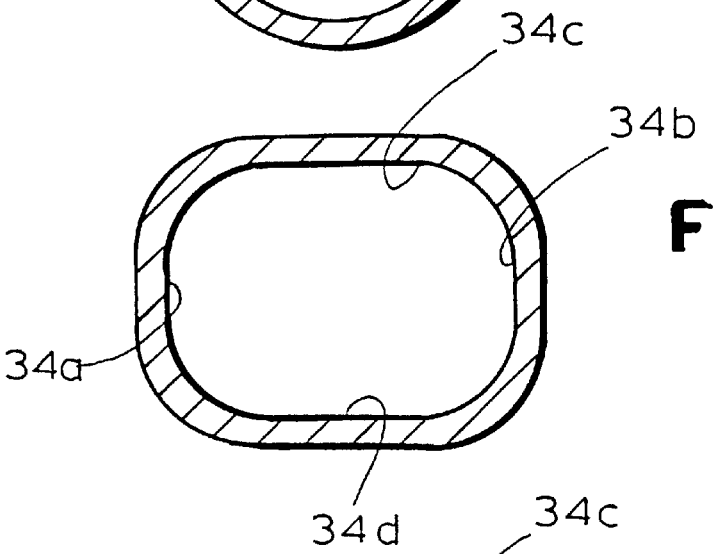
FIG. 4*a* is a cross-section taken in the plane 4*a*—4*a* of FIGS. 1*b* and 2*a*.
Figure 5A:
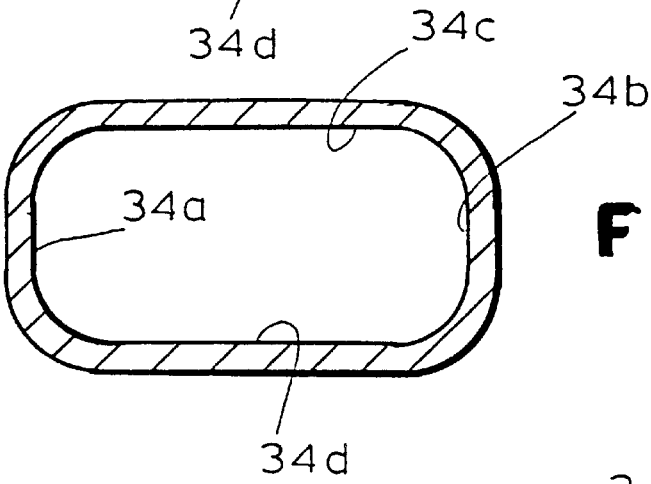
FIG. 5*a* is a cross-section taken in the plane 5*a*—5*a* of FIGS. 1*b* and 2*a*.
Figure 6C:
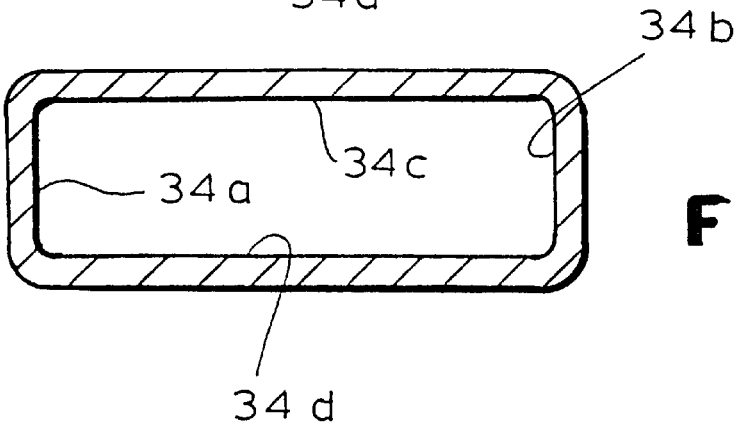
FIG. 6*c* is a cross-section taken in the 6*c*—6*c* of FIGS. 1*b* and 2*a*.

FIGS. 4*a*, 5*a* and 6*c* are cross-sections taken in the respective planes 4*a*—4*a*, 5*a*—5*a* and 6*c*—6*c* of FIGS. 1*b* and 2*a,* which are respectively disposed below plane 3*a*—3*a*. FIG. 4*a* shows four salient corners of large radius; FIG. 5*a* shows four salient corners of medium radius; and FIG. 6*c* shows four salient corners of small radius.

The flow divider 32 is disposed below the transition and there is thus created two axis 35 and 37. The included angle of the flow divider is generally equivalent to the divergence angle of the exit walls 38 and 39.

The area in plane 3*a*—3*a* is greater than the area of the two angled exits 35 and 37; and the flow from exits 35 and 37 has a lesser velocity than the flow in circular pipe section 30*b*. This reduction in the mean velocity of flow reduces turbulence occasioned by liquid from the nozzle entering the mold.

The total deflection is the sum of that produced within main transition 34 and that provided by the divergence of the exit walls 38 and 39. It has been found that a total deflection angle of approximately 30 degrees is nearly optimum for the continuous casting of thin steel slabs having widths in the range from 975 to 1625 mm or 38 to 64 inches, and thicknesses in the range of 50 to 60 mm. The optimum deflection angle is dependent on the width of the slab and to some extent upon the length, width and depth of the mold bulge B. Typically the bulge may have a length of 800 to 1100 mm, a width of 150 to 200 mm and a depth of 700 to 800 mm.

Referring now to FIGS. 1 and 2, an alternative casting nozzle is indicated generally by the reference numeral 30. The upper end of the nozzle includes an entry nozzle 30*a* terminating in a circular pipe 30*b* of 76 mm inside diameter which extends downwardly, as shown in FIGS. 1 and 2. The axis of pipe section 30*b* is considered as the axis S of the nozzle. Pipe section 30*b* terminates at the plane 3—3 which, as can be seen from FIG. 3, is of circular cross-section and has an area of 4536 $mm^2$. The flow then enters the main transition indicated generally by the reference numeral 34 and preferably having six walls 34*a* through 34*f*. Side walls 34*c* and 34*f* each diverge at an angle, preferably an angle of 10 degrees from the vertical. Front walls 34*d* and 34*e* are disposed at small angles relative to one another as are rear walls 34*a* and 34*b*. This is explained in detail subsequently. Front walls 34*d* and 34*e* converge with rear walls 34*a* and 34*b,* each at a mean angle of roughly 3.8 degrees from the vertical.

For a conical two-dimensional diffuser, it is customary to limit the included angle of the cone to approximately 8 degrees to avoid undue pressure loss due to incipient separation of flow. Correspondingly, for a one-dimensional rectangular diffuser, wherein one pair of opposed walls are parallel, the other pair of opposed walls should diverge at an included angle of not more than 16 degrees; that is, plus 8 degrees from the axis for one wall and minus 8 degrees from the axis for the opposite wall. In the diffusing main transition 34 of FIG. 1, the 3.8 degree mean convergence of the front and rear walls yields an equivalent one-dimensional divergence of the side walls of 10−3.8=6.2 degrees, approximately, which is less than the 8 degree limit.

FIGS. 4, 5 and 6 are cross-sections taken in the respective planes 4—4, 5—5 and 6—6 of FIGS. 1 and 2, which are respectively disposed 100, 200 and 351.6 mm below plane 3—3. The included angle between front walls 34*e* and 34*d* is somewhat less than 180 degrees as is the included angle between rear walls 34*a* and 34*b*. FIG. 4 shows four salient corners of large radius; FIG. 5 shows four salient corners of medium radius; and FIG. 6 shows four salient corners of small radius. The intersection of rear walls 34*a* and 34*b* may be provided with a filet or radius, as may the intersection of front walls 34*d* and 34*e*. The length of the flow passage is 111.3 mm in FIG. 4, 146.5 mm in FIG. 5, and 200 mm in FIG. 6.

Alternatively, as shown in FIG. 6*a*, the cross-section in plane 6—6 may have four salient corners of substantially zero radius. The front walls 34*e* and 34*d* and the rear walls 34*a* and 34*b* along their lines of intersection extend downwardly 17.6 mm below plane 6—6 to the tip 32*a* of flow divider 32. There is thus created two exits 35 and 37 respectively disposed at plus and minus 10 degree angles relative to the horizontal. Assuming that transition 34 has sharp salient corners in plane 6—6, as shown in FIG. 6*a*, each of the angled exits would be rectangular, having a slant length of 101.5 mm and a width of 28.4 mm, yielding a total area of 5776 $mm^2$.

The ratio of the area in plane 3—3 to the area of the two angled exits 35 and 37 is $\pi/4=0.785$; and the flow from exits 35 and 37 has 78.5% of the velocity in circular pipe section 30*b*. This reduction in the mean velocity of flow reduces turbulence occasioned by liquid from the nozzle entering the mold. The flow from exits 35 and 37 enters respective curved rectangular pipe sections 38 and 40. It will subsequently be shown that the flow in main transition 34 is substantially divided into two streams with higher fluid velocities adjacent side walls 34*c* and 34*f* and lower velocities adjacent the axis. This implies a bending of the flow in two opposite directions in main transition 34 approaching plus and minus 10 degrees. The curved rectangular pipes 38 and 40 bend the flows through further angles of 20 degrees. The curved sections terminate at lines 39 and 41. Downstream are respective straight rectangular pipe sections 42 and 44 which nearly equalize the velocity distribution issuing from the bending sections 38 and 40. Ports 46 and 48 are the exits of respective straight sections 42 and 44. It is desirable that the inner walls 38*a* and 40*a* of respective bending sections 38 and 40 have an appreciable radius of curvature, preferably not much less than half that of outer walls 38*b* and 40*b*. The inner walls 38*a* and 40*a* may have a radius of 100 mm; and outer walls 38*b* and 40*b* would have a radius of 201.5 mm. Walls 38*b* and 40*b* are defined by flow divider 32 which has a sharp leading edge with an included angle of 20 degrees. Divider 32 also defines walls 42*b* and 44*b* of the straight rectangular sections 42 and 44.

Figure 17:
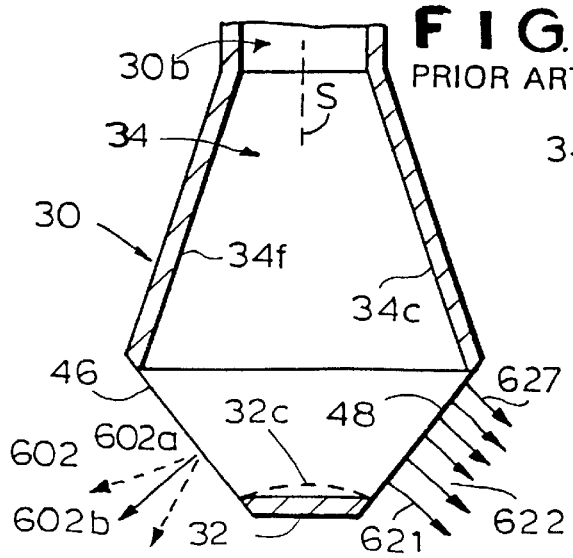
FIG. 17 PRIOR ART
FIG. 17 is an axial sectional view looking rearwardly of a prior art nozzle.
Figure 18:
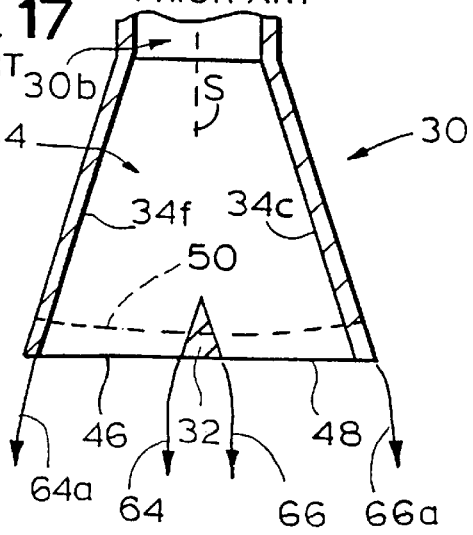
FIG. 18 PRIOR ART
FIG. 18 is an axial sectional view looking rearwardly of a further prior art nozzle.
Figure 19:
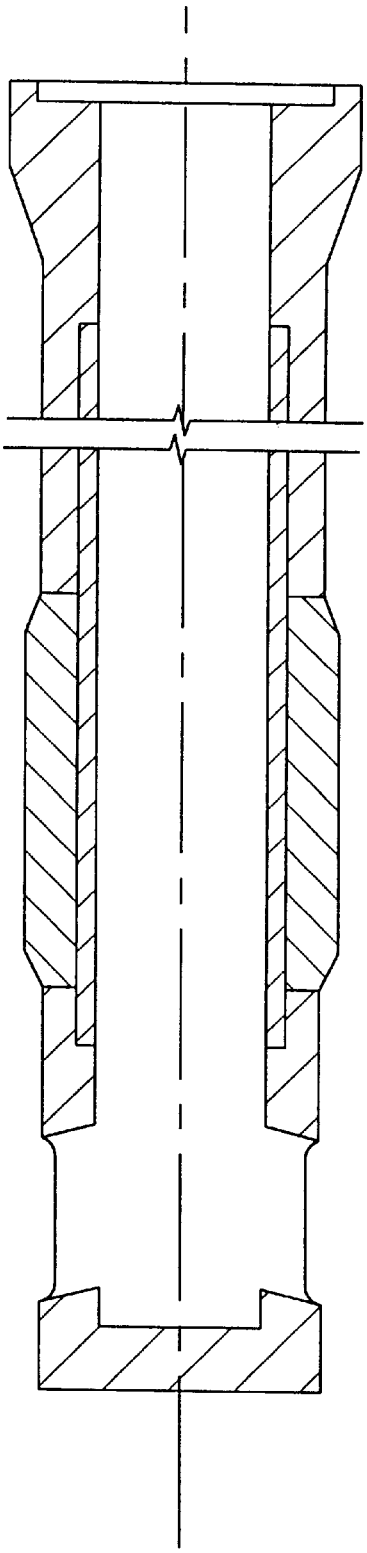
FIG. 19 PRIOR ART
FIG. 19 is an axial sectional view of another prior art nozzle.
Figure 20:
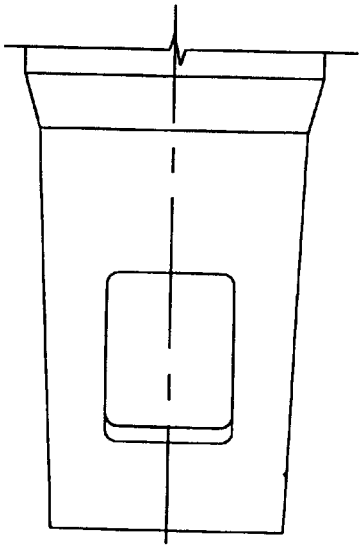
FIG. 20 PRIOR ART
FIG. 20 is a partial side sectional view of the prior art nozzle of FIG. 19.
Figure 21:
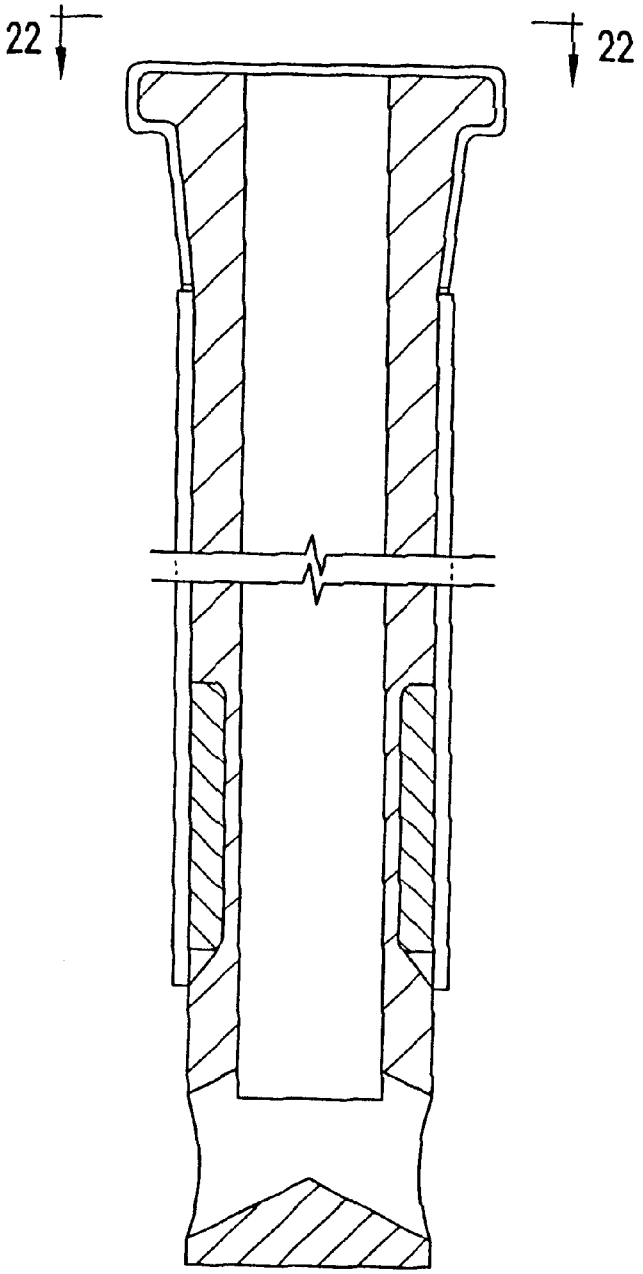
FIG. 21 PRIOR ART
FIG. 21 is an axial sectional view of another prior art nozzle.
Figure 22:
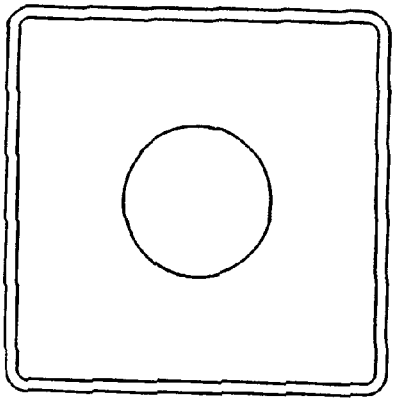
FIG. 22 PRIOR ART
FIG. 22 is top plan view on arrow A of the prior art nozzle of FIG. 21.
Figure 23:
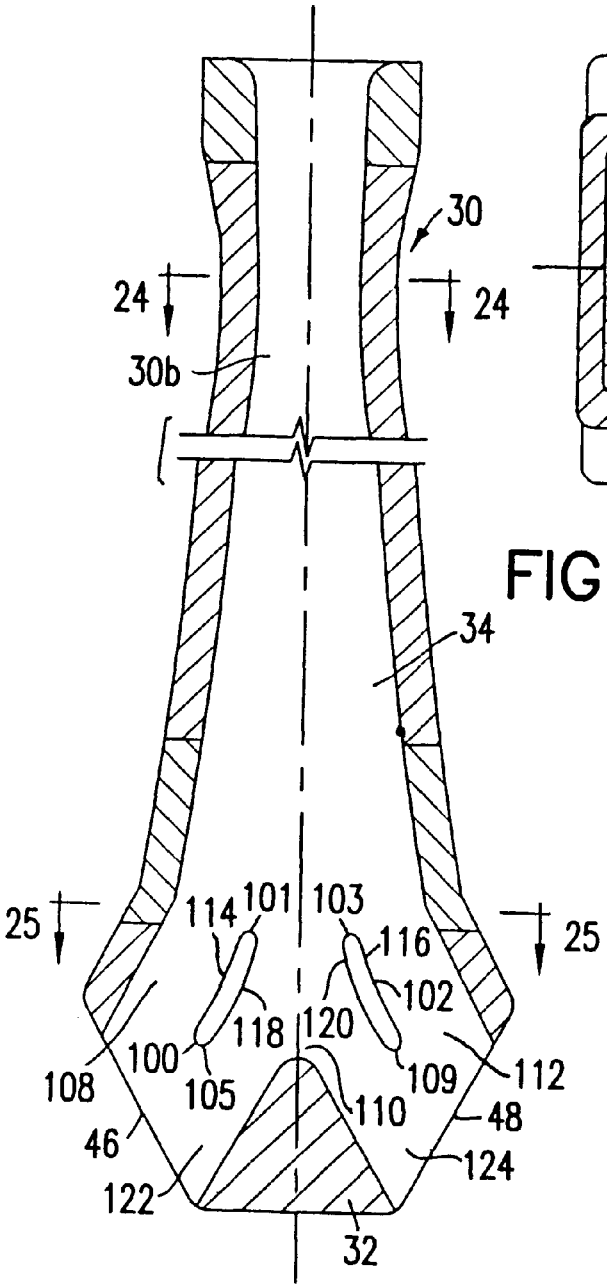
FIG. 23 shows an axial sectional view of an alternative embodiment of a casting nozzle of the present invention.
Figure 25:
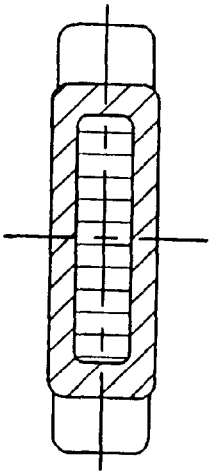
FIG. 25 shows a cross-sectional view of FIG. 23 taken across line B—B of FIG. 23.
Figure 27:
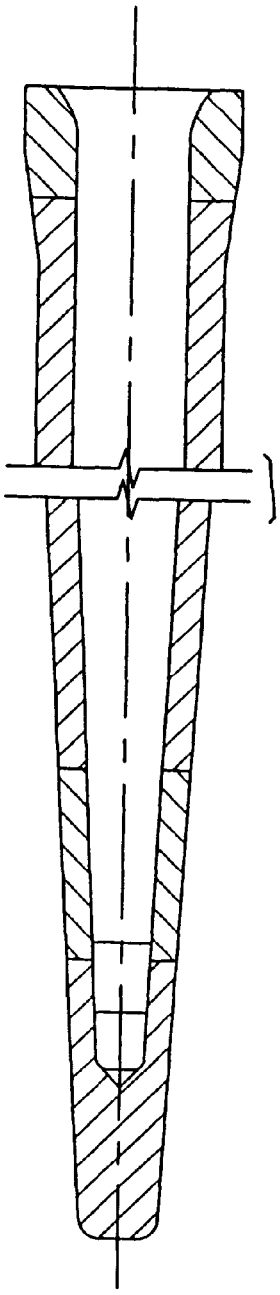
FIG. 27 shows a side axial sectional view of the casting nozzle of FIG. 23.
Figure 24:
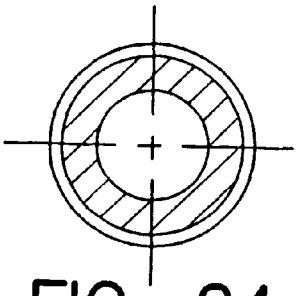
FIG. 24 shows a cross-sectional view of FIG. 23 taken across line A—A of FIG. 23.
Figure 26:
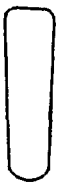
FIG. 26 shows a partial side axial sectional view of the casting nozzle of FIG. 23.

It will be understood that adjacent inner walls 38*a* and 40*a* there is a low pressure and hence high velocity whereas adjacent outer walls 38*b* and 40*b* there is a high pressure and hence low velocity. It is to be noted that this velocity profile in curved sections 38 and 40 is opposite to that of the prior art nozzles of FIGS. 17 and 18. Straight sections 42 and 44 permit the high-velocity low-pressure flow adjacent inner walls 38*a* and 40*a* of bending sections 38 and 40 a reasonable distance along walls 42*a* and 44*a* within which to diffuse to lower velocity and higher pressure.

The total deflection is plus and minus 30 degrees comprising 10 degrees produced within main transition 34 and 20 degrees provided by the curved pipe sections 38 and 40. It has been found that this total deflection angle is nearly optimum for the continuous casting of steel slabs having widths in the range from 975 to 1625 mm or 38 to 64 inches. The optimum deflection angle is dependent on the width of the slab and to some extent upon the length, width and depth of the mold bulge B. Typically the bulge may have a length of 800 to 1100 mm, a width of 150 to 200 mm and a depth of 700 to 800 mm. Of course it will be understood that where the section in plane 6—6 is as shown in FIG. 6, pipe sections 38, 40, 42 and 44 would no longer be perfectly rectangular but would be only generally so. It will be further appreciated that in FIG. 6, side walls 34*c* and 34*f* may be substantially semi-circular with no straight portion. The intersection of rear walls 34*a* and 34*b* has been shown as being very sharp, as along a line, to improve the clarity of the drawings. In FIG. 2, 340*b* and 340*d* represent the intersection of side wall 34*c* with respective front and rear walls 34*b* and 34*d*, assuming square salient corners as in FIG. 6*a*. However, due to rounding of the four salient corners upstream of plane 6—6, lines 340*b* and 340*d* disappear. Rear walls 34*a* and 34*b* are oppositely twisted relative to one another, the twist being zero in plane 3—3 and the twist being nearly maximum in plane 6—6. Front walls 34*d* and 34*e* are similarly twisted. Walls 38*a* and 42*a* and walls 40*a* and 44*a* may be considered as flared extensions of corresponding side walls 34*f* and 34*c* of the main transition 34.

Referring now to FIG. 1*a*, there is shown on an enlarged scale a flow divider 32 provided with a rounded leading edge. Curved walls 38*b* and 40*b* are each provided with a radius reduced by 5 mm, for example, from 201.5 to 196.5 mm. This produces, in the example, a thickness of over 10 mm within which to fashion a rounded leading edge of sufficient radius of curvature to accommodate the desired range of stagnation points without producing laminar separation. The tip 32*b* of divider 32 may be semi-elliptical, with vertical semi-major axis. Preferably tip 32*b* has the contour of an airfoil such, for example, as an NACA 0024 symmetrical wing section ahead of the 30% chord position of maximum thickness. Correspondingly, the width of exits 35 and 37 may be increased by 1.5 mm to 29.9 mm to maintain an exit area of 5776 $mm^2$.

Referring now to FIGS. 7 and 8, the upper portion of the circular pipe section 30*b* of the nozzle has been shown broken away. At plane 3—3 the section is circular. Plane 16—16 is 50 mm below plane 3—3. The cross-section is rectangular, 76 mm long and 59.7 mm wide so that the total area is again 4536 $mm^2$. The circular-to-rectangular transition 52 between planes 3—3 and 16—16 can be relatively short because no diffusion of flow occurs. Transition 52 is connected to a 25 mm height of rectangular pipe 54, terminating at plane 17—17, to stabilize the flow from transition 52 before entering the diffusing main transition 34, which is now entirely rectangular. The main transition 34 again has a height of 351.6 mm between planes 17—17 and 6—6 where the cross-section may be perfectly hexagonal, as shown in FIG. 6*a*. The side walls 34*c* and 34*f* diverge at an angle of 10 degrees from the vertical, and the front walls and rear walls converge at a mean angle, in this case, of approximately 2.6 degrees from the vertical. The equivalent one-dimensional diffuser wall angle is now 10−2.6=7.4 degrees, approximately, which is still less than the generally used 8 degrees maximum. The rectangular pipe section 54 may be omitted, if desired, so that transition 52 is directly coupled to main transition 34. In plane 6—6 the length is again 200 mm and the width adjacent walls 34*c* and 34*f* is again 28.4 mm. At the centerline of the nozzle the width is somewhat greater. The cross-sections in planes 4—4 and 5—5 are similar to those shown in FIGS. 4 and 5 except that the four salient corners are sharp instead of rounded. The rear walls 34*a* and 34*b* and the front walls 34*d* and 34*e* intersect along lines which meet the tip 32*a* of flow divider 32 at a point 17.6 mm below plane 6—6. Angled rectangular exits 35 and 37 again each have a slant length of 101.5 mm and a width of 28.4 mm yielding a total exit area of 5776 $mm^2$. The twisting of front wall 34*b* and rear wall 34*d* is clearly seen in FIG. 8.

In FIGS. 7 and 8, as in FIGS. 1 and 2, the flows from exits 35 and 37 of transition 34 pass through respective rectangular turning sections 38 and 40, where the respective flows are turned through an additional 20 degrees relative to the vertical, and then through respective straight rectangular equalizing sections 42 and 44. The flows from sections 42 and 44 again have total deflections of plus and minus 30 degrees from the vertical. The leading edge of flow divider 32 again has an included angle of 20 degrees. Again it is preferable that the flow divider 32 has a rounded leading edge and a tip (32*b*) which is semi-elliptical or of airfoil contour as in FIG. 1*a*.

Figure 9:
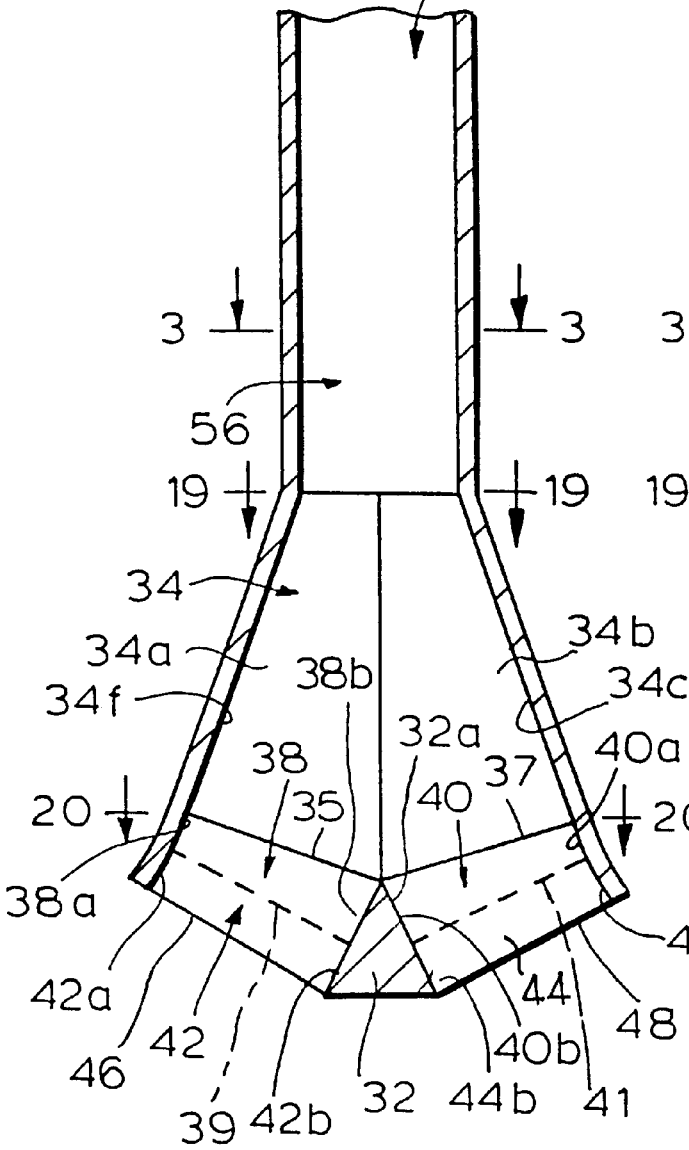
FIG. 9 is an axial sectional view looking rearwardly of a third casting nozzle having a round-to-square transition with moderate diffusion, a hexagonal medium-angle diverging main transition with constant flow area, and low terminal bending.
Figure 10:
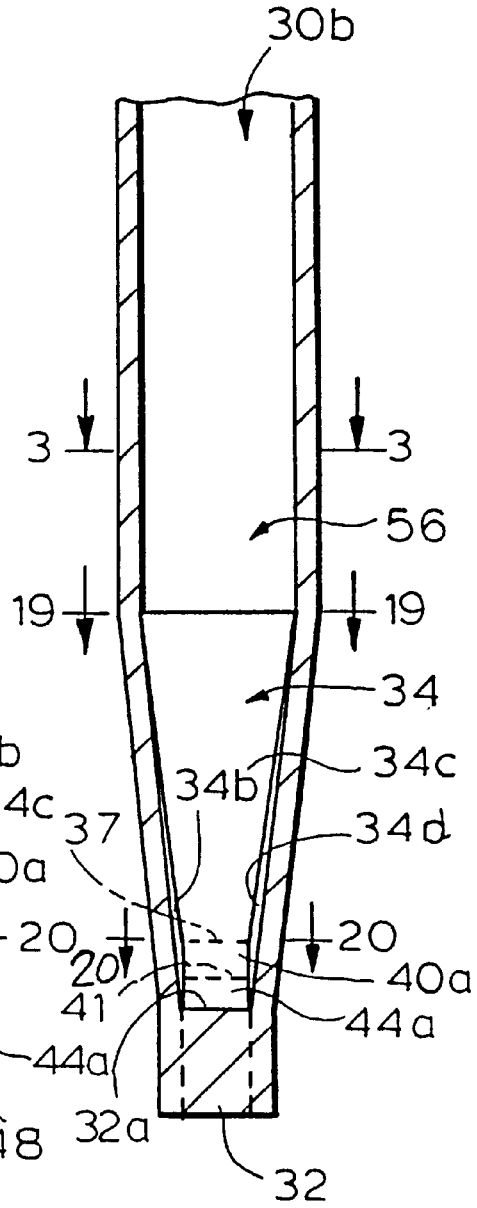
FIG. 10 is an axial sectional view looking to the right of the nozzle of FIG. 9.

Referring now to FIGS. 9 and 10, between planes 3—3 and 19—19 is a circular-to-square transition 56 with diffusion. The area in plane 19—19 is $76^2$=5776 $mm^2$. The distance between planes 3—3 and 19—19 is 75 mm; which is equivalent to a conical diffuser where the wall makes an angle of 3.5 degrees to the axis and the total included angle between walls is 7.0 degrees. Side walls 34*c* and 34*f* of transition 34 each diverge at an angle of 20 degrees from the vertical while rear walls 34*a*–34*b* and front walls 34*d*–34*e* converge in such a manner as to provide a pair of rectangular exit ports 35 and 37 disposed at 20 degree angles relative to the horizontal. Plane 20—20 lies 156.6 mm below plane 19—19. In this plane the length between walls 34*c* and 34*f* is 190 mm. The lines of intersection of the rear walls 34*a*–34*b* and of the front walls 34*d*–34*e* extend 34.6 mm below plane 20—20 to the tip 32*a* of divider 32. The two angled rectangular exit ports 35 and 37 each have a slant length of 101.1 mm and a width of 28.6 mm yielding an exit area of 5776 $mm^2$ which is the same as the entrance area of the transition in plane 19—19. There is no net diffusion within transition 34. At exits 35 and 37 are disposed rectangular turning sections 38 and 40 which, in this case, deflect each of the flows only through an additional 10 degrees. The leading edge of flow divider 32 has an included angle of 40 degrees. Turning sections 38 and 40 are followed by respective straight rectangular sections 42 and 44. Again, the inner walls 38*a* and 40*a* of sections 38 and 40 may have a radius of 100 mm which is nearly half of the 201.1 mm radius of the outer walls 38*b* and 40*b*. The total deflection is again plus and minus 30 degrees. Preferably flow divider 32 is provided with a rounded leading edge and a tip (32*b*) which is semi-elliptical or of airfoil contour by reducing the radii of walls 38*b* and 40*b* and, if desired, correspondingly increasing the width of exits 35 and 37.

Figure 11:
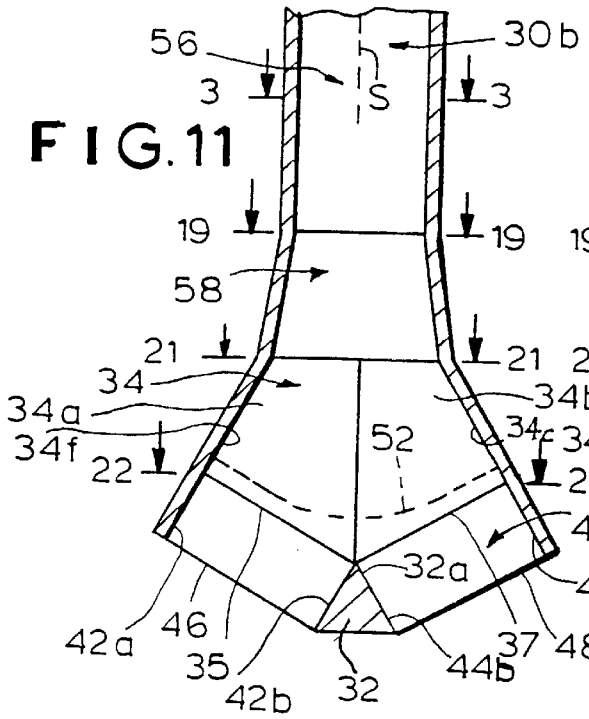
FIG. 11 is an axial sectional view looking rearwardly of a fourth casting nozzle providing round-to-square and square-to-rectangular transitions of high total diffusion, a hexagonal high-angle diverging main transition with decreasing flow area, and no terminal bending.
Figure 12:
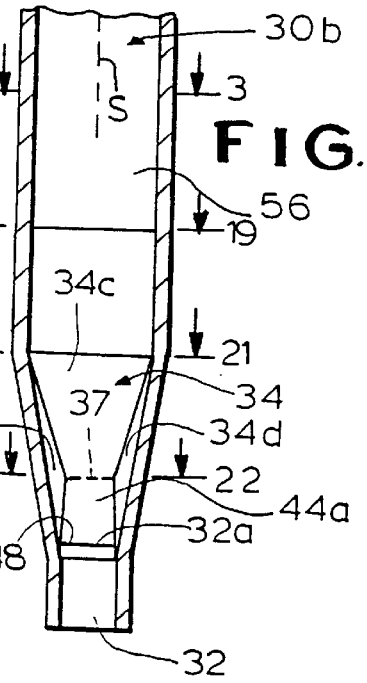
FIG. 12 is an axial sectional view looking to the right of the nozzle of FIG. 11.

Referring now to FIGS. 11 and 12, in plane 3—3 the cross-section is again circular; and in plane 19—19 the cross-section is square. Between planes 3—3 and 19—19 is a circular-to-square transition 56 with diffusion. Again, separation in the diffuser 56 is obviated by making the distance between planes 3—3 and 19—19 75 mm. Again the area in plane 19—19 is $76^2$=5776 $mm^2$. Between plane 19—19 and plane 21—21 is a one-dimensional square-to-rectangular diffuser. In plane 21—21 the length is $(4/\pi)76$= 96.8 mm and the width is 76 mm, yielding an area of 7354 $mm^2$. The height of diffuser 58 is also 75 mm; and its side walls diverge at 7.5 degree angles from the vertical. In main transition 34, the divergence of each of side walls 34*c* and 34*f* is now 30 degrees from the vertical. To ensure against flow separation with such large angles, transition 34 provides a favorable pressure gradient wherein the area of exit ports 35 and 37 is less than in the entrance plane 21—21. In plane 22—22, which lies 67.8 mm below plane 21—21, the length between walls 34*c* and 34*f* is 175 mm. Angled exit ports 35 and 37 each have a slant length of 101.0 mm and a width of 28.6 mm, yielding an exit area of 5776 $mm^2$. The lines of intersection of rear walls 34*a*–34*b* and front walls 34*d*–34*e* extend 50.5 mm below plane 22—22 to the tip 32*a* of divider 32. At the exits 35 and 37 of transition 34 are disposed two straight rectangular sections 42 and 44. Sections 42 and 44 are appreciably elongated to recover losses of deflection within transition 34. There are no intervening turning sections 38 and 40; and the deflection is again nearly plus and minus 30 degrees as provided by main transition 34. Flow divider 32 is a triangular wedge having a leading edge included angle of 60 degrees. Preferably divider 32 is provided with a rounded leading edge and a tip (32*b*) which is of semi-elliptical or airfoil contour, by moving walls 42*a* and 42*b* outwardly and thus increasing the length of the base of divider 32. The pressure rise in diffuser 58 is, neglecting friction, equal to the pressure drop which occurs in main transition 34. By increasing the width of exits 35 and 37, the flow velocity can be further reduced while still achieving a favorable pressure gradient in transition 34.

In FIG. 11, 52 represents an equipotential of flow near exits 35 and 37 of main transition 34. It will be noted that equipotential 52 extends orthogonally to walls 34*c* and 34*f*, and here the curvature is zero. As equipotential 52 approaches the center of transition 34, the curvature becomes greater and greater and is maximum at the center of transition 34, corresponding to axis S. The hexagonal cross-section of the transition thus provides a turning of the flow streamlines within transition 34 itself. It is believed the mean deflection efficiency of a hexagonal main transition is more than ⅔ and perhaps ¾ or 75% of the apparent deflection produced by the side walls.

In FIGS. 1–2 and 7–8 the 2.5 degrees loss from 10 degrees in the main transition is almost fully recovered in the bending and straight sections. In FIGS. 9–10 the 5 degrees loss from 20 degrees in the main transition is nearly recovered in the bending and straight sections. In FIGS. 11–12 the 7.5 degrees loss from 30 degrees in the main transition is mostly recovered in the elongated straight sections.

Figure 13:
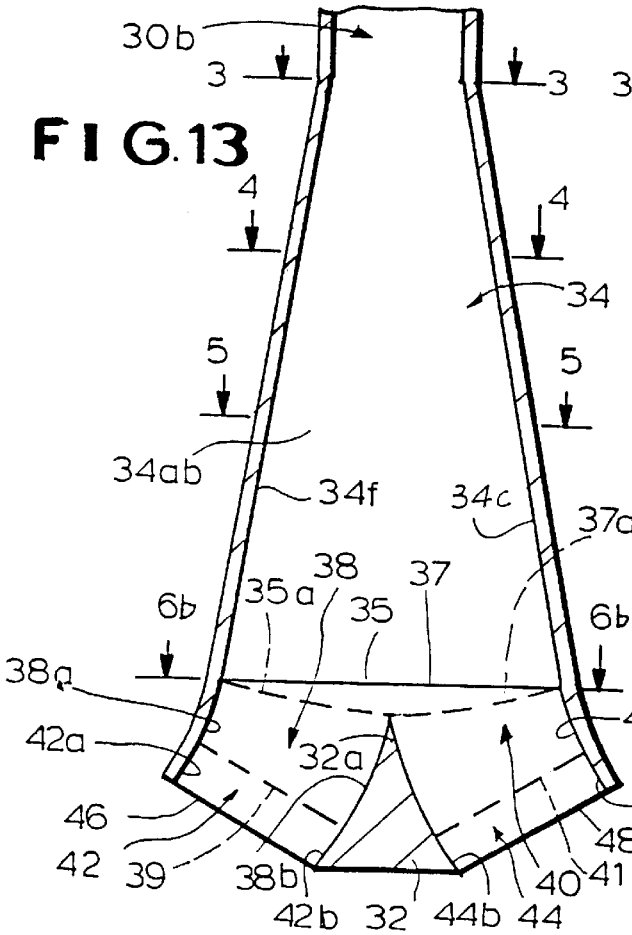
FIG. 13 is an axial sectional view looking rearwardly of a fifth casting nozzle similar to that of FIG. 1 but having a rectangular main transition.
Figure 14:
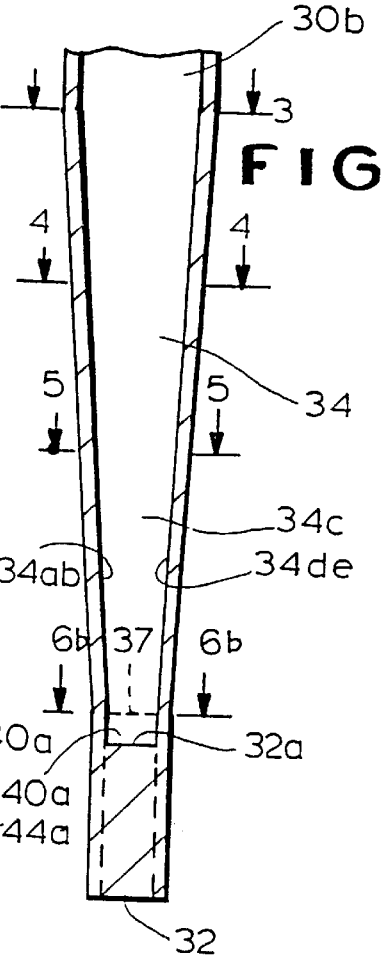
FIG. 14 is an axial sectional view looking to the right of the nozzle of FIG. 13.

Referring now to FIGS. 13 and 14, there is shown a variant of FIGS. 1 and 2 wherein the main transition 34 is provided with only four walls, the rear wall being 34*ab* and the front wall being 34*de*. The cross-section in plane 6—6 may be generally rectangular as shown in FIG. 6*b*. Alternatively, the cross-section may have sharp corners of zero radius. Alternatively, the side walls 34*c* and 34*f* may be of semi-circular cross-section with no straight portion, as shown in FIG. 17*b*. The cross-sections in planes 4—4 and 5—5 are generally as shown in FIGS. 4 and 5 except, of course, rear walls 34*a* and 34*b* are collinear as well as front walls 34*e* and 34*d*. Exits 35 and 37 both lie in plane 6—6. The line 35*a* represents the angled entrance to turning section 38; and the line 37*a* represents the angled entrance to turning section 40. Flow divider 32 has a sharp leading edge with an included angle of 20 degrees. The deflections of flow in the left-hand and right-hand portions of transition 34 are perhaps 20% of the 10 degree angles of side walls 34*c* and 34*f*, or mean deflections of plus and minus 2 degrees. The angled entrances 35*a* and 37*a* of turning sections 38 and 40 assume that the flow has been deflected 10 degrees within transition 34. Turning sections 38 and 40 as well as the following straight sections 42 and 44 will recover most of the 8 degree loss of deflection within transition 34; but it is not to be expected that the deflections from ports 46 and 48 will be as great as plus and minus 30 degrees. Divider 32 preferably has a rounded leading edge and a tip (32*b*) which is semi-elliptical or of airfoil contour as in FIG. 1*a*.

Figure 15:
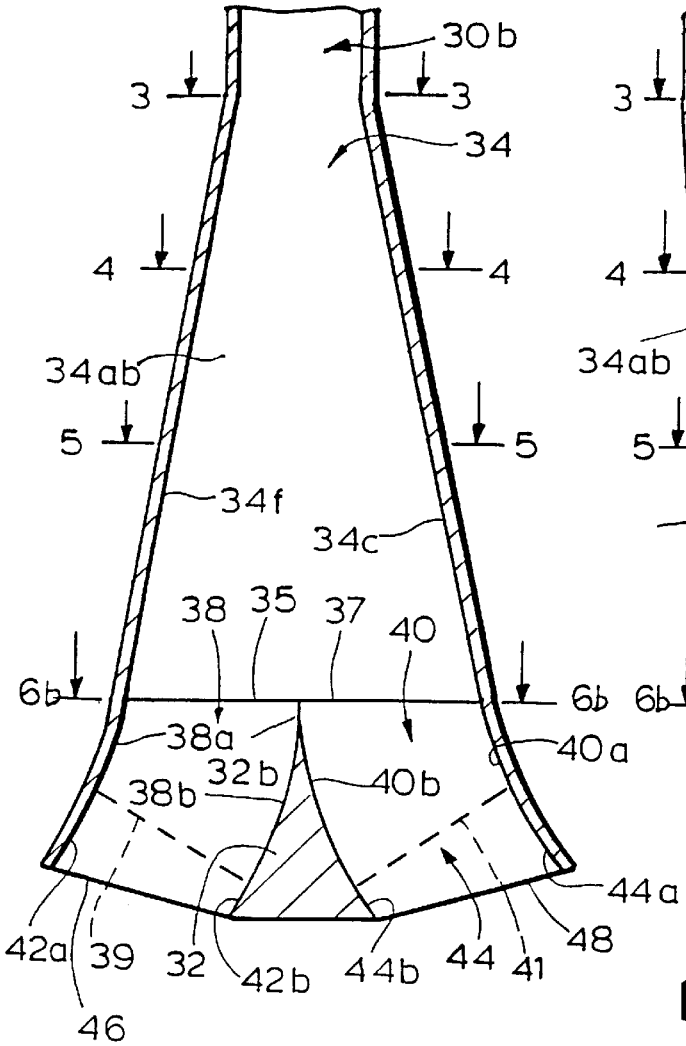
FIG. 15 is an axial sectional view looking rearwardly of a sixth casting nozzle having a rectangular small-angle diverging main transition with diffusion, minor flow deflection within the main transition, and high terminal bending.
Figure 16:
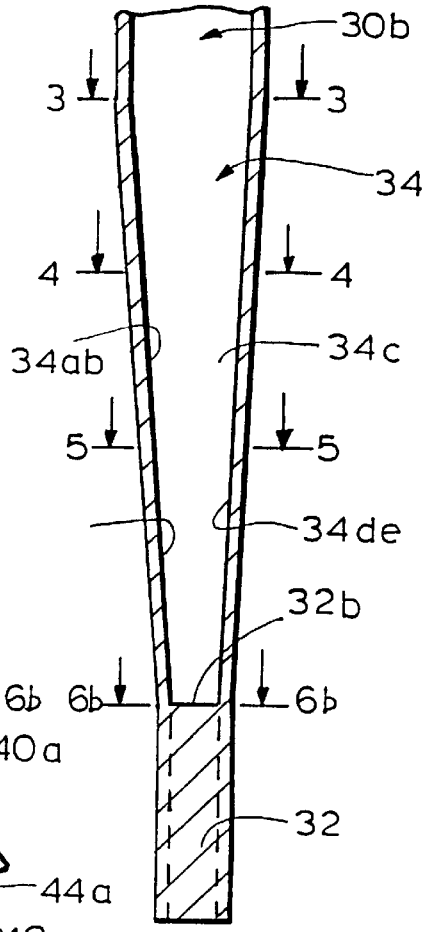
FIG. 16 is an axial sectional view looking to the right of the nozzle of FIG. 15.

Referring now to FIGS. 15 and 16, there is shown a further nozzle similar to that shown in FIGS. 1 and 2. Transition 34 again has only four walls, the rear wall being 34*ab* and the front wall being 34*de*. The cross-section in plane 6—6 may have rounded corners as shown in FIG. 6*b* or may alternatively be rectangular with sharp corners. The cross-sections in planes 4—4 and 5—5 are generally as shown in FIGS. 4 and 5 except rear walls 34*a*–34*b* are collinear as are front walls 34*d*–34*e*. Exits 35 and 37 both lie in plane 6—6. In this embodiment of the invention, the deflection angles at exits 35–37 are assumed to be zero degrees. Turning sections 38 and 40 each deflect their respective flows through 30 degrees. In this case, if flow divider 32 were to have a sharp leading edge, it would be in the nature of a cusp with an included angle of zero degrees, which construction would be impractical. Accordingly, walls 38*b* and 40*b* have a reduced radius so that the leading edge of the flow divider 32 is rounded and the tip (32*b*) is semi-elliptical or preferably of airfoil contour. The total deflection is plus and minus 30 degrees as provided solely by turning sections 38 and 40. Outlet ports 46 and 48 of straight sections 42 and 44 are disposed at an angle from the horizontal of less than 30 degrees, which is the flow deflection from the vertical.

Walls 42*a* and 44*a* are appreciably longer than walls 42*b* and 44*b*. Since the pressure gradient adjacent walls 42*a* and 44*a* is unfavorable, a greater length is provided for diffusion. The straight sections 42 and 44 of FIGS. 15–16 may be used in FIGS. 1–2, 7–8, 9–10, and 13–14. Such straight sections may also be used in FIGS. 11–12; but the benefit would not be as great. It will be noted that for the initial one-third of turning sections 38 and 40 walls 38*a* and 40*a* provide less apparent deflection than corresponding side walls 34*f* and 34*c*. However, downstream of this, flared walls 38*a* and 40*a* and flared walls 42*a* and 44*a* provide more apparent deflection than corresponding side walls 34*f* and 34*c*.

In an initial design similar to FIGS. 13 and 14 which was built and successfully tested, side walls 34*c* and 34*f* each had a divergence angle of 5.2 degrees from the vertical; and rear wall 34*ab* and front wall 34*de* each converged at an angle of 2.65 degrees from the vertical. In plane 3—3, the flow cross-section was circular with a diameter of 76 mm. In plane 4—4, the flow cross-section was 95.5 mm long and 66.5 mm wide with radii of 28.5 mm for the four corners. In plane 5—5 the cross-section was 115 mm long and 57.5 mm wide with radii of 19 mm for the corners. In plane 6—6, which was disposed 150 mm, instead of 151.6 mm, below plane 5—5, the cross-section was 144 mm long and 43.5 mm wide with radii of 5 mm for the corners; and the flow area was 6243 $mm^2$. Turning sections 38 and 40 were omitted. Walls 42*a* and 44*a* of straight sections 40 and 42 intersected respective side walls 34*f* and 34*c* in plane 6—6. Walls 42*a* and 44*a* again diverged at 30 degrees from the vertical and were extended downwardly 95 mm below plane 6—6 to a seventh horizontal plane. The sharp leading edge of a triangular flow divider 32 having an included angle of 60 degrees (as in FIG. 11) was disposed in this seventh plane. The base of the divider extended 110 mm below the seventh plane. The outlet ports 46 and 48 each had a slant length of 110 mm. It was found that the tops of ports 46 and 48 should be submerged at least 150 mm below the meniscus. At a casting rate of 3.3 tons per minute with a slab width of 1384 mm, the height of standing waves was only 7 to 12 mm; no surface vortices formed in the meniscus; no oscillation was evident for mold widths less than 1200 mm; and for mold width greater than this, the resulting oscillation was minimal. It is believed that this minimal oscillation for large mold widths may result from flow separation on walls 42*a* and 44*a*, because of the extremely abrupt terminal deflection, and because of flow separation downstream of the sharp leading edge of flow divider 32. In this initial design, the 2.65 degree convergence of the front and rear walls 34*ab* and 34*de* was continued in the elongated straight sections 42 and 44. Thus these sections were not rectangular with 5 mm radius corners but were instead slightly trapezoidal, the top of outlet ports 46 and 48 had a width of 35 mm and the bottom of outlet ports 46 and 48 had a width of 24.5 mm. We consider that a section which is slightly trapezoidal is generally rectangular.

Referring now to FIGS. 23–29, there is shown alternative embodiments of the present invention. These casting nozzles are similar to the casting nozzles of the present invention, but include baffles 100–106 to incorporate multiple stages of flow division into separate streams with independent deflection of these streams within the interior of the nozzle. It should be realized, however, by those skilled in the art that the baffles do not have to be used with the nozzles of the present invention, but can be used with any of the known or prior art casting or submerged entry nozzles just so long as the baffles 100–106 are used to incorporate multiple stages of flow division into separate streams with independent deflection of these streams within the interior of the nozzle.

With respect to FIGS. 23–27, there is shown a casting nozzle 30 of the present invention, e.g., a casting nozzle having a transition section 34 where there is a transition from axial symmetry to planar symmetry within this section so as to diffuse or decelerate the flow and therefore reduce the inertial force of the flow exiting the nozzle 30. After the metal flow proceeds along the transition section 34, it encounters baffles 100, 102 which are located within or inside the nozzle 30. Preferably, the baffles should be positioned so that the upper edges 101, 103 of the baffles 100, 102, respectively, are upstream of the exit ports 46, 48. The lower edges 105, 107 of the baffles 100, 102, respectively, may or may not be positioned upstream of the exit ports 46, 48, although it is preferred that the lower edges 105, 107 are positioned upstream of the exit ports 46, 48.

The baffles 100, 102 function to diffuse the liquid metal flowing through the nozzle 30 in multiple stages. The baffles first divide the flow into three separate streams 108, 110 and 112. The streams 108, 112 are considered the outer streams and the stream 110 is considered a central stream. The baffles 100, 102 include upper faces 114, 116, respectively, and lower faces 118, 120, respectively. The baffles 100, 102 cause the two outer streams 108, 112 to be independently deflected in opposite directions by the upper faces 114, 116 of the baffles. The baffles 100, 102 should be constructed and arranged to provide an angle of deflection of approximately 20–90 degrees, preferably, 30 degrees, from the vertical.

The central stream 110 is diffused by the diverging lower faces 118, 120 of the baffles. The central stream 110 is subsequently divided by the flow divider 32 into two inner streams 122, 124 which are oppositely deflected at angles matching the angles that the outer streams 108, 112 are deflected, e.g., 20–90 degrees, preferably 30 degrees, from the vertical.

Because the two inner streams 122, 124 are oppositely deflected at angles matching the angles that the outer streams 108, 112 are deflected, the outer streams 108, 112 are then recombined with the inner streams 122, 124, respectively, i.e., its matching stream, within the nozzle 30 before the streams of molten metal exit the nozzle 30 and are released into a mold.

The outer streams 108, 112 recombine with the inner streams 122, 124, respectively, within the nozzle 30 for an addition reason. The additional reason is that if the lower edges 105, 107 of the baffles 100, 102, are upstream of the exit ports 46, 48, i.e., do not fully extend to the exit ports 46, 48, the outer streams 108, 112 are no longer being physically separated from the inner streams 122, 124 before the streams exit the nozzle 30.

Figure 29:
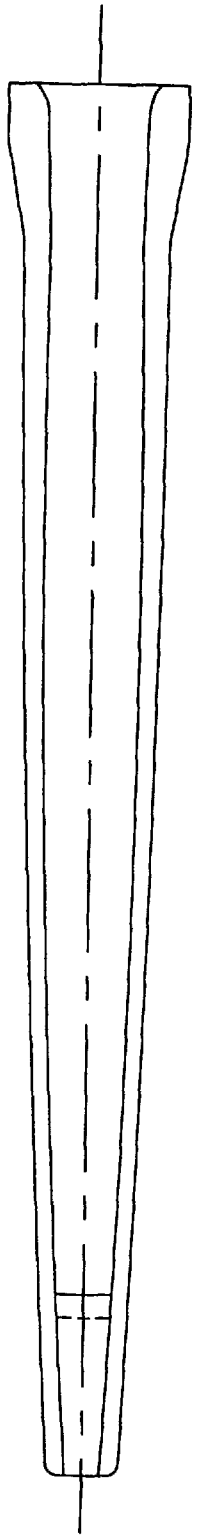
FIG. 29 shows a side axial sectional view of the casting nozzle of FIG. 28.
Figure 28:
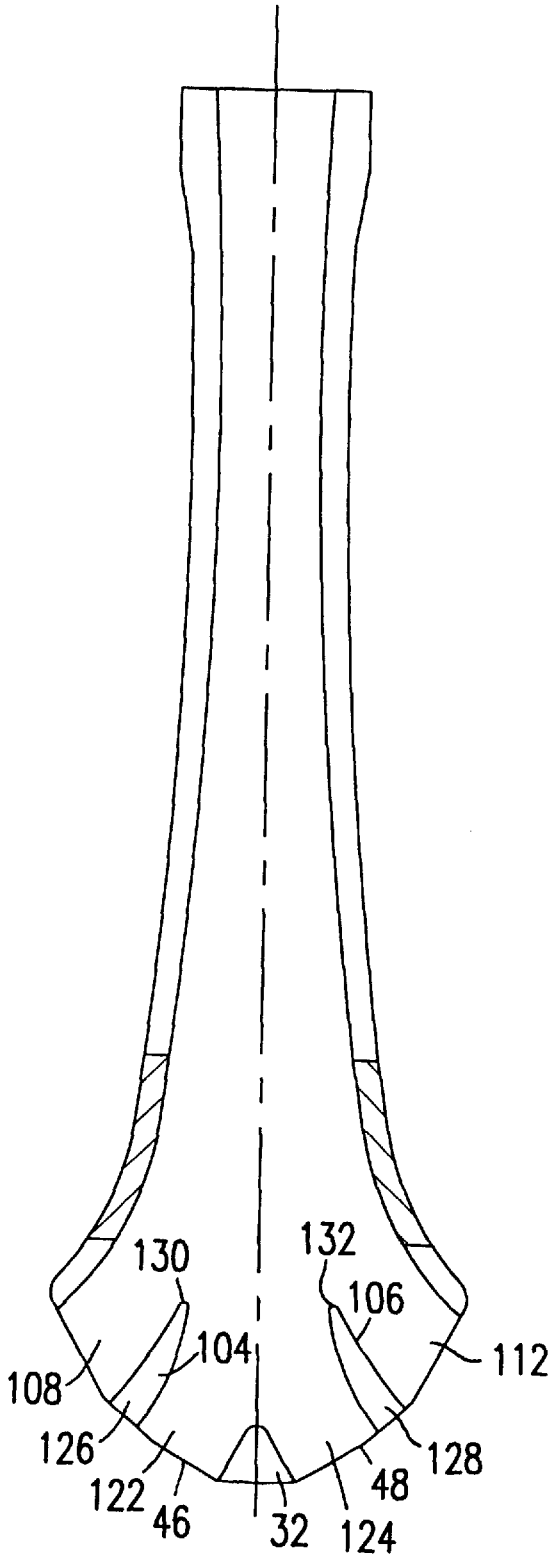
FIG. 28 shows an axial sectional view of an alternative embodiment of a casting nozzle of the present invention.

FIGS. 28–29 show an alternative embodiment of the casting nozzle 30 of the present invention. In this embodiment, the upper edges 130, 132, but not the lower edges 126, 128, of the baffles 104, 106 are positioned upstream of the exit ports 46, 48. This completely separates the outer streams 108, 112 and the inner streams 122, 124 within the nozzle 30. Moreover, in this embodiment, the deflection angles of the outer streams 108, 112 and the inner streams 122, 124 do not match. As a result, the outer streams 108, 112 and the inner streams 122, 124 do not recombine within the nozzle 30.

Preferably, the baffles 104, 106 and the flow divider 32 are constructed and arranged so that the outer streams 108, 112 are deflected approximately 45 degrees from the vertical, and the inner streams 122, 124 are deflected approximately 30 degrees from the vertical. Depending on the desired mold flow distribution, this embodiment allows independent adjustment of the deflection angles of the outer and inner streams.

It will be seen that we have accomplished the objects of our invention. By providing diffusion and deceleration of flow velocity between the inlet pipe and the outlet ports, the velocity of flow from the ports is reduced, velocity distribution along the length and width of the ports is rendered generally uniform, and standing wave oscillation in the mold is reduced. Deflection of the two oppositely directed streams is accomplished by providing a flow divider which is disposed below the transition from axial symmetry to planar symmetry. By diffusing and decelerating the flow in the transition, a total stream deflection of approximately plus and minus 30 degrees from the vertical can be achieved while providing stable, uniform velocity outlet flows.

In addition, deflection of the two oppositely directed streams can be accomplished in part by providing negative pressures at the outer portions of the streams. These negative pressures are produced in part by increasing the divergence angles of the side walls downstream of the main transition. Deflection can be provided by curved sections wherein the inner radius is an appreciable fraction of the outer radius. Deflection of flow within the main transition itself can be accomplished by providing the transition with a hexagonal cross-section having respective pairs of front and rear walls which intersect at included angles of less than 180 degrees. The flow divider is provided with a rounded leading edge of sufficient radius of curvature to prevent vagaries in stagnation point due either to manufacture or to slight flow oscillation from producing a separation of flow at the leading edge which extends appreciably downstream.

Finally, the casting nozzles of FIGS. 23–28 improve the flow behavior associated with the introduction of liquid metal into a mold via a casting nozzle. In prior art nozzles, the high inertial forces of the liquid metal flowing in the bore of the nozzle led to flow separation in the region of the exit ports causing high velocity, and unstable, turbulent, exit jets which do not achieve their apparent flow deflection angles.

With the casting nozzles of FIGS. 23–28, the inertial force is divided and better controlled by dividing the flow into separate and independent streams within the bore of the nozzle in a multiple stage fashion. This results in the alleviation of flow separation, and therefore the reduction of turbulence, stabilizes the exit jets, and achieves a desired deflection angle.

Moreover, the casting nozzle of FIGS. 28–29 provide the ability to achieve independent deflection angles of the outer and inner streams. These casting nozzles are particularly suited for casting processes where the molds of are of a confined geometry. In these cases, it is desirable to distribute the liquid metal in a more diffuse manner.

It will be understood that certain features and subcombinations are of utility and may be employed without reference to other features of subcombinations. This is contemplated by and is within the scope of our claims. It is therefore to be understood that our invention is not to be limited to the specific details shown and described.

What is claimed is:

1. A casting nozzle for flowing liquid metal therethrough, comprising:

an elongated bore having an entry port and at least first and second exit ports;

at least one baffle positioned proximate to each exit port to divide the flow of liquid metal into two outer streams and a central stream, the baffles including upper faces and substantially diverging lower faces, the upper faces for deflecting the outer streams in substantially opposite directions and the lower faces for diffusing the central stream; and a flow divider positioned downstream of the baffles such that the flow divider and lower faces of the baffles divide the flow of liquid metal exiting the first or second exit port into at least two separate streams.

2. The casting nozzle of claim 1, wherein the flow divider divides the diffused central stream into two inner streams, the flow divider and the lower faces deflecting the respective two inner streams in substantially the same respective directions in which the two outer streams are deflected.

3. The casting nozzle of claim 2, wherein the respective outer and inner streams recombine before the streams exit at least one of the exit ports.

4. The casting nozzle of claim 2, wherein the respective outer and inner streams recombine after the streams exit at least one of the exit ports.

5. The casting nozzle of claim 1, wherein the flow divider divides the diffused flow into two inner streams, the flow divider and the lower faces deflecting the respective two inner streams in a different direction than the respective directions in which the two outer streams are deflected.

6. The casting nozzle of claim 1, wherein the upper faces deflect the outer streams at an angle of deflection of approximately 20–90 degrees from the vertical.

7. The casting nozzle of claim 6, wherein the upper faces deflect the outer stream at an angle of approximately 30 degrees from the vertical.

8. The casting nozzle of claim 1, wherein the bore includes a transition section in fluid communication with the baffles to substantially continuously change the nozzle's cross sectional symmetry from a generally axially symmetry to a generally planar symmetry.

9. A casting nozzle for flowing liquid metal therethrough comprising:

an elongated bore having an entry port and at least two exit ports;

a first baffle positioned proximate to the one exit port and a second baffle positioned proximate to the other exit port, wherein the baffles divide the flow of liquid metal into two outer streams and a central stream, the baffles including upper faces and substantially diverging lower faces, the upper faces for deflecting the two outer streams in substantially opposite directions and the lower faces for diffusing the central stream; and a flow divider positioned downstream of the baffles to divide the central stream into two inner streams and to cooperate with the baffles to deflect the respective two inner streams in substantially the same respective directions in which the two outer streams are deflected.

10. The casting nozzle of claim 9, wherein the respective outer and inner streams recombine before the streams exit at least one of the exit ports.

11. The casting nozzle of claim 10, wherein the baffles deflect the outer streams at an angle of approximately 30 degrees from the vertical.

12. The casting nozzle of claim 9, wherein the respective outer and inner streams recombine after the streams exit at least one of the exit ports.

13. The casting nozzle of claim 9, wherein the baffles deflect the respective two inner streams in substantially the same direction as the respective directions in which the two outer streams are deflected.

14. The casting nozzle of claim 13, wherein the baffles deflect the two outer streams at an angle of approximately 45 degrees from the vertical, and deflect the two inner streams at an angle of approximately 30 degrees from the vertical.

15. The casting nozzle of claim 9, wherein the baffles deflect the outer streams at an angle of deflection of approximately 20–90 degrees from the vertical.

16. A casting nozzle for flowing liquid metal therethrough, comprising;

an elongated entrance pipe section having a first cross-sectional flow area and a generally axial symmetry;

a diffusing transition section in fluid communication with the pipe section, the transition section adapted and arranged to substantially continuously change the nozzle's cross-sectional flow area in the transition section from the first cross-sectional flow area to a generally elongated second cross-sectional flow area which is greater in cross-sectional flow area than the first cross-sectional flow area, and to substantially continuously change the nozzle's symmetry in the transition section from the generally axial symmetry to a generally planar symmetry;

at least two exit ports in fluid communication with the transition section;

a first baffle positioned proximate to the one exit port and a second baffle positioned proximate to the other exit port, wherein the baffles divide the flow of liquid metal from the transition section into two outer streams and a central stream, the baffles including upper faces and substantially diverging lower faces, the upper faces for deflecting the two outer streams in substantially opposite directions and the lower faces for diffusing the central stream; and a flow divider positioned downstream of, and in fluid communication with, the baffles to divide the central stream into two inner streams, and to cooperate with the baffles to deflect the respective two inner streams in substantially the same respective directions in which the two outer streams are deflected.

17. The method of claim 16, further comprising the step of recombining the respective outer and inner streams before the streams exit the at least one exit port.

18. A method for flowing liquid metal through a casting nozzle comprising the steps of:

flowing liquid metal through an elongated bore having an entrance port and at least one exit port;

dividing the flow of liquid metal into two outer streams and a central stream;

deflecting the two outer streams in substantially opposite directions at respective angles of approximately 45 degrees from the vertical;

dividing the central stream into two inner streams; and deflecting the respective two inner streams in substantially the same respective directions in which the two outer streams are deflected at respective angles of approximately 30 degrees from the vertical.

19. The method of claim 18, further comprising the step of recombining the outer and inner streams after the streams exit the at least one exit port.

20. A casting nozzle for flowing liquid metal therethrough, comprising:

means for flowing liquid metal through an elongated bore having an entrance port and at least one exit port;

means for dividing the flow of liquid metal into two outer streams and a central stream, the means for dividing the flow of liquid metal including at least one baffle positioned proximate to each exit port, the baffles including upper faces and substantially diverging lower faces;

means for deflecting the two outer streams in substantially opposite directions, the means for deflecting the two outer streams including the upper faces of the baffles;

means for dividing the central stream into two inner streams, the means for dividing the central stream into two inner streams including a flow divider positioned downstream of the baffles;

means for diffusing the central stream which includes the substantially diverging lower faces of the baffles; and means for deflecting the respective two inner streams in substantially the same respective directions in which the two outer reams are deflected.

21. The casting nozzle of claim 20, including means for recombining the outer and inner streams before the streams exit the at least one exit port.

22. The casting nozzle of claim 20, including means for recombining the outer and inner streams after the streams exit the at least one exit port.

23. A casting nozzle for flowing liquid metal therethrough, comprising:

an elongated bore having an entry port and at least one exit port;

a baffle positioned proximate to one of the exit ports to divide the flow of liquid metal into first and second streams, the baffle including an upper face and a substantially diverging lower face, the upper face for deflecting the first stream in one direction and the lower face for diffusing the second stream; and a flow divider positioned downstream of the baffle to divide the second stream into two separate streams prior to its egress through the at least one exit port.

24. A method for flowing liquid metal through a casting nozzle comprising the steps of:

flowing liquid metal through an elongated bore having an entrance port and at least one exit port;

dividing the flow of liquid metal into two outer streams and a central stream using a baffle positioned proximate to each exit port, the baffles including upper faces and substantially diverging lower faces;

diffusing the central stream using the substantially diverging lower faces of the baffles; and dividing the central stream into two inner streams using a flow divider positioned downstream of the baffles.

25. The method of claim 24, further comprising the step of deflecting the two outer streams in substantially opposite directions using the upper faces of the baffles.

26. The method of claim 25, further comprising the step of deflecting the respective two inner streams in substantially the same respective directions in which the two outer streams are deflected using the flow divider in communication with the lower faces of the baffles.

27. The method of claim 24, further comprising the step of recombining the outer and inner streams after the streams exit the at least one exit port.

28. The method of claim 24, further comprising the step of deflecting the outer streams at an angle of deflection of approximately 20–90 degrees from the vertical.

29. The method of claim 28, further comprising the step of deflecting the outer streams at an angle of approximately 30 degrees from the vertical.

30. The method of claim 24, further comprising the step of deflecting the two outer streams at an angle of approximately 45 degrees from the vertical, and deflecting the two inner streams at an angle of approximately 30 degrees from the vertical.

31. The casting nozzle of claim 24, wherein the flow divider is positioned downstream of the baffles such that the flow divider and lower faces of the baffles divide the flow of liquid metal exiting each exit port into at least two separate streams.

32. A casting nozzle for flowing liquid metal therethrough, comprising:

an elongated bore having an entry port and at least first and second exit ports;

at least one baffle positioned proximate to the exit port to divide the flow of liquid metal into at least two outer streams and a central stream, the baffles including upper faces and lower faces, the upper faces for deflecting the outer streams in substantially opposite directions and the lower faces for diffusing the central stream; and a flow divider positioned downstream of the baffles.

33. The casting nozzle of claim 32, wherein the flow divider divides the diffused central stream into two inner streams.

34. The casting nozzle of claim 33, wherein the respective two inner streams are deflected in substantially the same respective directions in which the two outer streams are deflected.

35. A casting nozzle for flowing liquid metal therethrough, comprising:

an elongated bore having an entry port and at least first and second exit ports;

a first baffle positioned upstream of the first exit port and a second baffle positioned upstream of the second exit port, the first and second baffles for dividing the flow of liquid metal into at least two outer streams and a central stream, the baffles including upper faces and lower faces, the upper faces for deflecting the outer streams in substantially opposite directions and the lower faces for diffusing the central stream; and a flow divider positioned downstream of the baffles.

36. The casting nozzle of claim 35, wherein the flow divider divides the diffused central stream into two inner streams.

37. The casting nozzle of claim 35, wherein the respective two inner streams are deflected in substantially the same respective directions in which the two outer streams are deflected.

38. The casting nozzle of claim 35, wherein the respective outer and inner streams recombine before the streams exit at least one of the exit ports.

39. The casting nozzle of claim 35, wherein the upper faces deflect the outer streams at an angle of deflection of approximately 20–90 degrees from the vertical.

40. The casting nozzle of claim 35, wherein the upper faces deflect the outer stream at an angle of approximately 30 degrees from the vertical.

* * * * *